US010591170B2

(12) United States Patent
Lee et al.

(10) Patent No.: US 10,591,170 B2
(45) Date of Patent: Mar. 17, 2020

(54) AIR CONDITIONER

(71) Applicant: SAMSUNG ELECTRONICS CO., LTD., Suwon-si, Gyeonggi-do (KR)

(72) Inventors: Kyeong Ae Lee, Suwon-si (KR); Kwon Jin Kim, Suwon-si (KR); Sung Jae Kim, Seongnam-si (KR); Jong Youb Kim, Suwon-si (KR); Seon Uk Na, Yongin-si (KR); Yeon-Seob Yun, Hwaseong-si (KR); Young Uk Yun, Suwon-si (KR); Byung Han Lim, Suwon-si (KR); Sung-June Cho, Suwon-si (KR); Jong Kweon Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 4 days.

(21) Appl. No.: 16/003,465

(22) Filed: Jun. 8, 2018

(65) Prior Publication Data

US 2019/0024909 A1 Jan. 24, 2019

(30) Foreign Application Priority Data

Jul. 21, 2017 (KR) ..... 10-2017-0092636
Dec. 22, 2017 (KR) ..... 10-2017-0178383

(51) Int. Cl.
*F24B 1/06* (2006.01)
*F28F 13/12* (2006.01)
(Continued)

(52) U.S. Cl.
CPC ..... *F24F 1/0033* (2013.01); *F24F 1/0007* (2013.01); *F24F 1/0035* (2019.02);
(Continued)

(58) Field of Classification Search
CPC ..... F24F 1/0014; F24F 1/0011; F24F 1/0022; F24F 1/0003; F24F 1/005; F24F 1/0033;
(Continued)

(56) References Cited

U.S. PATENT DOCUMENTS

2016/0040896 A1* 2/2016 Hong ..... F24F 1/005 165/221
2017/0016633 A1* 1/2017 Jeon ..... F24F 1/0014
(Continued)

FOREIGN PATENT DOCUMENTS

KR 2000-0056578 9/2000
KR 2001-0004057 1/2001
(Continued)

OTHER PUBLICATIONS

International Search Report dated Oct. 19, 2018 in corresponding International Patent Application No. PCT/KR2018/007374.

*Primary Examiner* — Davis D Hwu
(74) *Attorney, Agent, or Firm* — Staas & Halsey LLP

(57) ABSTRACT

Provided is an air conditioner including a housing, a suction port disposed in the housing, a first discharge port disposed in the housing to discharge a part of air sucked through the suction port, and a second discharge port disposed in the housing to discharge other part of air sucked through the suction port, a heat exchanger configured to perform heat-exchange on the part of air sucked through the suction port, a first blowing fan configured to suck the part of air, which is sucked through the suction port, to discharge the sucked air to the first discharge port, and an intermediate member configured to guide the part of air sucked through the suction port to the heat exchanger, and configured to separate other part of air s sucked through the suction port from the part of air sucked through the suction port.

19 Claims, 17 Drawing Sheets

(51) Int. Cl.

| | |
|---|---|
| ***F24F 1/0033*** | (2019.01) |
| ***F24F 1/0007*** | (2019.01) |
| ***F24F 1/0035*** | (2019.01) |
| ***F24F 13/08*** | (2006.01) |
| ***F24F 1/02*** | (2019.01) |
| *F24F 1/005* | (2019.01) |
| *F24F 13/20* | (2006.01) |
| *F24F 11/00* | (2018.01) |

(52) U.S. Cl.
CPC ..... *F24F 1/02* (2013.01); *F24F 13/082* (2013.01); *F24F 1/005* (2019.02); *F24F 13/085* (2013.01); *F24F 13/20* (2013.01); *F24F 2011/0002* (2013.01)

(58) Field of Classification Search
CPC ..... F24F 1/0035; F24F 1/0007; F24F 1/02; F24F 13/082; F24F 13/085; F24F 13/20; F24F 2001/0002
USPC ..... 165/124
See application file for complete search history.

(56) References Cited

U.S. PATENT DOCUMENTS

2017/0023264 A1* 1/2017 Ha ..... F24F 1/0003
2018/0356107 A1* 12/2018 Lee ..... F24F 1/0022

FOREIGN PATENT DOCUMENTS

| | | |
|---|---|---|
| KR | 10-2008-0101474 | 11/2008 |
| KR | 10-2011-0018740 | 2/2011 |
| KR | 10-2012-0036142 | 4/2012 |
| KR | 10-1234065 | 2/2013 |
| KR | 10-2013-0103288 | 9/2013 |
| KR | 10-2016-0051095 | 5/2016 |
| KR | 10-2017-0077660 | 7/2017 |

* cited by examiner

AIR CONDITIONER

CROSS-REFERENCE TO RELATED APPLICATION(S)

This application is based on and claims priority under 35 U.S.C. § 119 to Korean Patent Application No. 10-2017-0092636, filed on Jul. 21, 2017, and No. 10-2017-0178383, filed on Dec. 22, 2017 in the Korean Intellectual Property Office, the disclosures of which are incorporated by reference herein in its entirety

BACKGROUND

Field

Embodiments of the present disclosure relate to an air conditioner, and more particularly, to an air conditioner having a variety of air discharging methods.

Description of Related Art

Generally, an air conditioner is an apparatus that uses a refrigeration cycle to control temperature, humidity, airflow, and distribution to be suitable for human activity, and to remove dust in the air. A compressor, a condenser, an evaporator, an expansion valve, and a blowing fan are provided as main components of the refrigeration cycle.

The air conditioner may be classified into a separate type-air conditioner in which an indoor unit and an outdoor unit are separated, and an integrated type-air conditioner in which an indoor unit and an outdoor unit are installed together in a single cabinet. The indoor unit of the separate type air conditioner includes a heat exchanger for exchanging heat with the air sucked into a panel, and a blowing fan for sucking indoor air into the panel and blowing the sucked air back into the indoor.

In a conventional manner, when a user directly comes into contact with the discharged air, the user can feel the cold and the uncomfortable feeling. On the other hand, when the user does not come into contact with the discharged air, the user feels the heat and the uncomfortable feeling.

SUMMARY

Therefore, it is an aspect of the present disclosure to provide an air conditioner capable of having various air discharging methods.

It is another aspect of the present disclosure to provide an air conditioner capable of cooling and heating the room at a minimum wind speed at which a user feels comfortable.

It is another aspect of the present disclosure to provide an air conditioner capable of providing natural winds which is not heat-exchanged.

It is another aspect of the present disclosure to provide an air conditioner capable of providing air in which heat-exchanged air and room air are mixed with each other.

It is another aspect of the present disclosure to provide an air conditioner capable of allowing a flow path, in which heat-exchanged air flows, and a flow path, in which natural winds flows, to be effectively arranged.

Additional aspects of the present disclosure will be set forth in part in the description which follows and, in part, will be obvious from the description, or may be learned by practice of the present disclosure.

In accordance with an aspect of the present disclosure, an air conditioner includes a housing, a suction port disposed in the housing, a first discharge port disposed in the housing to discharge a part of air sucked through the suction port, and a second discharge port disposed in the housing to discharge other part of air sucked through the suction port, a heat exchanger configured to perform heat-exchange on the part of air sucked through the suction port, a first blowing fan configured to suck the part of air, which is sucked through the suction port, to discharge the sucked air to the first discharge port, and an intermediate member configured to guide the part of air sucked through the suction port to the heat exchanger, and configured to separate other part of air s sucked through the suction port from the part of air sucked through the suction port.

the intermediate member includes a guide portion configured to form at least one part of a first flow path connecting the suction port to the first discharge port, and configured to guide air in the first flow path, to the heat exchanger, and a partition configured to divide between a second flow path connecting the suction port to a second discharge port, and the first flow path.

The suction port includes a first suction port through which the part of air is sucked, to allow the part of air to be discharged to the first discharge port; and a second suction port through which the other part of air is sucked, to allow the other part of air to be discharged to the second discharge port.

The intermediate member includes a guide portion configured to form at least one part of a first flow path connecting the first suction port to the first discharge port, and configured to guide air in the first flow path, to the heat exchanger, and a partition configured to divide between a second flow path connecting the second suction port to the second discharge port, and the first flow path The first discharge port is disposed on a front surface of the housing and the second discharge port is disposed on a side surface of the housing, and the partition is extended from the outside of the guide portion to the side surface of the housing.

A side end portion of the partition is in contact with an inner side surface of the housing to divide between the first flow path and the second flow path.

One surface of the partition guides air, which is sucked through the first suction port, to the first discharge port, and other surface of the partition guides air, which is sucked through the second suction port, to the second discharge port.

The first flow path is formed by the guide portion and the one surface of the partition, and the second flow path is formed by the inner side surface of the housing and the other surface of the partition.

The guide portion comprises a bell mouth portion configured to guide air, which is sucked through the first suction port, to flow to the first blowing fan; and a diffuser portion configured to guide the air, which is blown by the first blowing fan, to flow to the heat exchanger.

The intermediate member further comprises an inlet disposed in a lower portion of the intermediate member and configured to be opened in a vertical direction to allow air, which is blown by the second blowing fan disposed between the second suction port and the intermediate member, to flow thereinto, and the guide portion is configured to be opened in a frontward and backward direction, to allow air to flow into the first blowing fan to guide air to the heat exchanger.

The air conditioner further includes a discharge panel disposed in the front side of the first discharge port and provided with a plurality of discharge holes.

The air conditioner further includes a second blowing fan configured to suck air through the second suction port to discharge the air to the second discharge port; and a guide curved portion configured to guide air, which is discharged through the second discharge port, to the front side so that the air, which is discharged through the second discharge port, is mixed with air, which is discharged through the first discharge port.

The second blowing fan is configured to discharge air, which is discharged through the second discharge port, at a speed faster than a speed of air, which is discharged through the discharge panel.

The air conditioner further includes a third discharge port disposed on at least one side between an upper side or a lower side of the first discharge port, and a third flow path communicating between the second flow path and the third discharge port is disposed between the second flow path and the third discharge port.

The air conditioner further includes a second blowing fan disposed on the second flow path and configured to suck other part of air, which is sucked through the suction port to discharge the air to the second discharge port; and a guide curved portion configured to guide air, which is discharged through the second discharge port, to the front side so that the air, which is discharged through the second discharge port, is mixed with air, which is discharged through the first discharge port.

In accordance with another aspect of the present disclosure, an air conditioner includes a housing provided with a first suction port and a second suction port, a first discharge port disposed in the housing to discharge air sucked through the first suction port, a second discharge port disposed in the housing to discharge air sucked through the second suction port, a first flow path configured to connect the first suction port to the first discharge port, a second flow path configured to connect the second suction port to the second discharge port and configured to be separated from the first flow path, a heat exchanger disposed on the first flow path, and an intermediate member provided with a partition configured to divide between the first flow path and the second flow path; and a guide portion configured to guide air in the first flow path, to the first discharge port, and the first flow path is formed by the guide portion and the partition, and the second flow path is formed by the partition and an inner side surface of the housing.

The air conditioner further includes a first blowing fan disposed in a circumferential direction of an inner circumferential surface of the guide portion and configured to move air in the first flow path; and a second blowing fan disposed in a lower side of the intermediate member and configured to move air in the second flow path, and the first blowing fan blows air in first flow path, from the rear side to the front side, and the second blowing fan blows air in second flow path, from the lower side to the upper side.

The partition is extended from the guide portion to the inner side surface of the housing, and a side end portion of the partition is in contact with the inner side surface of the housing to divide between the first flow path and the second flow path.

The first discharge port is disposed to allow air, which is heat-exchanged, to be discharged, and the second discharge port is disposed to allow air, which is not heat-exchanged, to be discharged.

In accordance with the other aspect of the present disclosure, an air conditioner includes a housing provided with a first suction port and a second suction port, a first discharge port disposed on a front surface of the housing to discharge air sucked through the first suction port; and a second discharge port disposed on a side surface of the housing to discharge air sucked through the second suction port, a discharge panel disposed on the front side of the first discharge port and provided with a plurality of discharge holes, a heat exchanger configured to perform heat-exchange on air sucked through the first suction port, a first blowing fan configured to suck air through the first suction port to discharge the air through the first discharge port, a second blowing fan configured to suck air through the second suction port to discharge the air through the second discharge port, and an intermediate member disposed inside of the housing and configured to guide air, which is suck through the first suction port, to the first discharge port, and the intermediate member comprises a guide portion configured to cover an outer circumferential surface of the first blowing fan, and a partition extended to the outside of the guide portion while being extended to a side surface of the housing, to separate air, which is sucked through the second suction port, from air, which is sucked through the first suction port.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
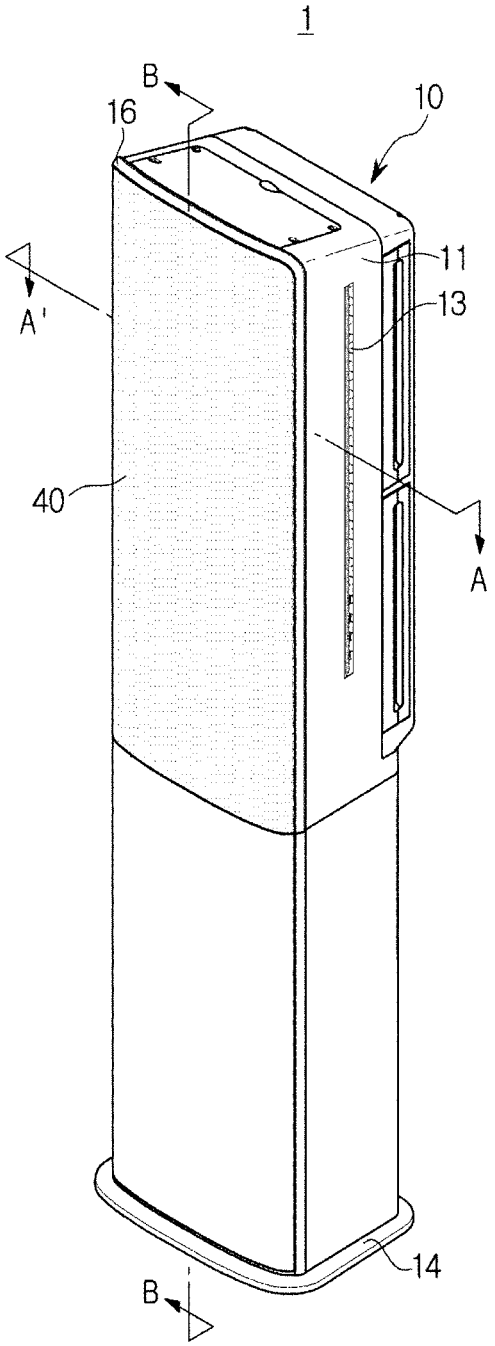
FIG. 1 is a perspective view of an air conditioner according to an embodiment of the present disclosure.

Embodiments described in the present disclosure and configurations shown in the drawings are merely examples of the embodiments of the present disclosure, and may be modified in various different ways at the time of filing of the present application to replace the embodiments and drawings of the present disclosure.

In addition, the same reference numerals or signs shown in the drawings of the present disclosure indicate elements or components performing substantially the same function.

Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

In the following detailed description, the terms of "front", "upper portion", "lower portion", "left side", "right side" and the like may be defined by the drawings, but the shape and the location of the component is not limited by the term.

A refrigeration cycle of an air conditioner is provided with a compressor, a condenser, an expansion valve, and an evaporator. The refrigeration cycle is a series of processes of compression-condensation-expansion-evaporation, and air, which is heat-exchanged with refrigerant, may be supplied through the refrigeration cycle.

The compressor compresses refrigerant gas into a state of high temperature and high pressure and discharges the refrigerant gas at the high temperature and pressure, and the discharged refrigerant gas flows into the condenser. The condenser condenses the compressed refrigerant into a liquid phase and the heat is discharged to the surroundings through the condensation process.

The expansion valve expands the liquid refrigerant at the high-temperature and high-pressure state, which is condensed in the condenser, into the liquid refrigerant at the low-pressure state. The evaporator evaporates the refrigerant, which is expanded in the expansion valve and return the refrigerant gas at the low-temperature and low-pressure state, to the compressor. The evaporator uses the evaporation latent heat of the refrigerant to achieve a refrigerating effect by the heat exchange with the object to be cooled. Through this cycle, an air temperature of the indoor space may be adjusted.

The outdoor unit of the air conditioner refers to a portion composed of a compressor and an outdoor heat exchanger in the refrigeration cycle. The indoor unit of the air conditioner may include the indoor heat exchanger and the expansion valve may be located either in the indoor unit or the outdoor unit. The indoor heat exchanger and the outdoor heat exchanger serve as a condenser serves and an evaporator. When the indoor heat exchanger serves as a condenser, an air conditioner may correspond to a heater and when the indoor heat exchanger serves as an evaporator, an air conditioner may correspond to a cooler.

Hereinafter, embodiments of the present disclosure will be described in detail with reference to the accompanying drawings.

Figure 2:
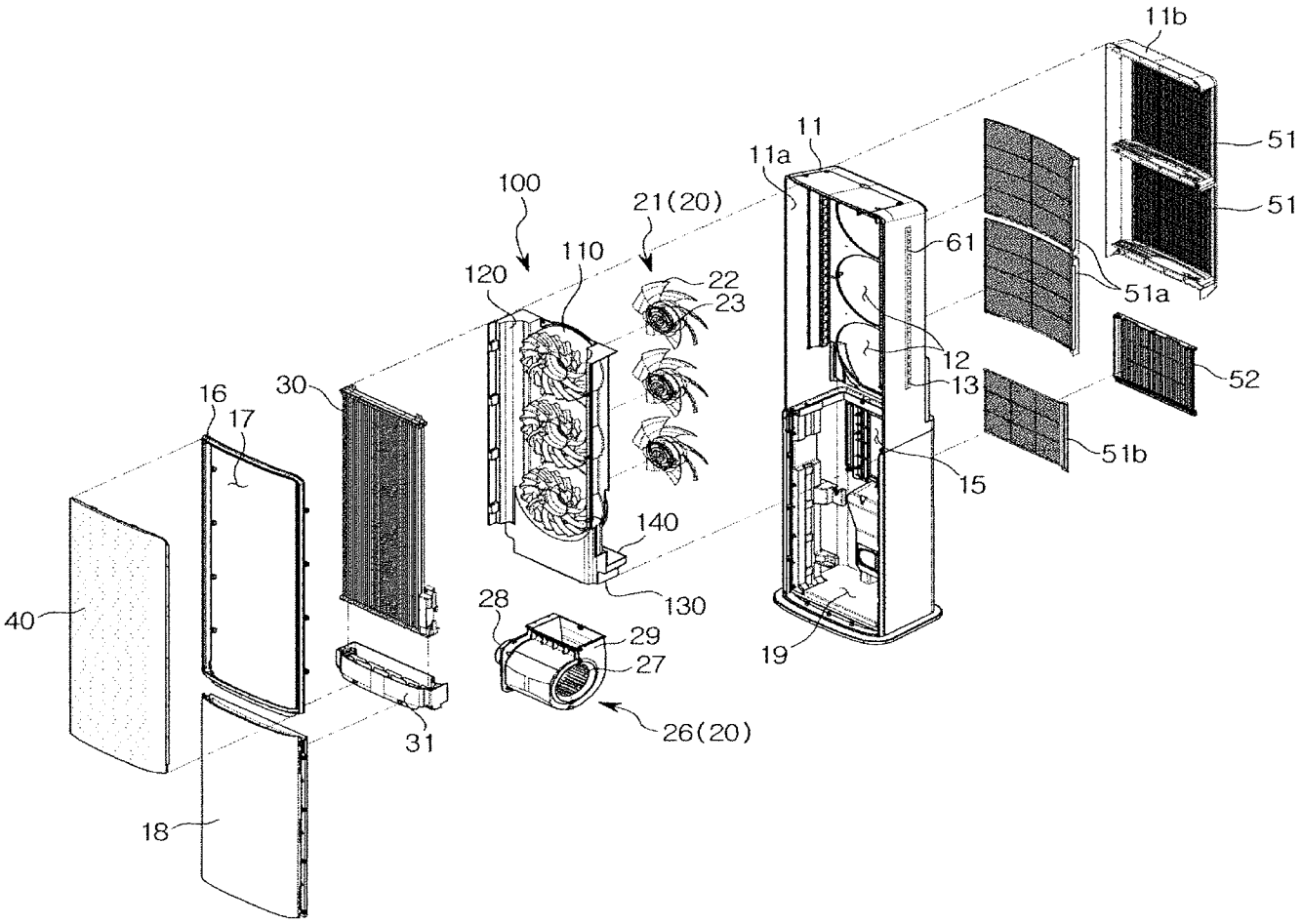
FIG. 2 is an exploded view of the air conditioner shown in FIG. 1

FIG. 1 is a perspective view of an air conditioner 1 according to an embodiment. FIG. 2 is an exploded view of the air conditioner 1 shown in FIG. 1

Referring to FIGS. 1 and 2, the air conditioner 1 may include a housing 10 forming an exterior of the air conditioner 1, a blowing unit 20 circulating air to the inside or the outside of the housing 10, and a heat exchanger 30 performing heat exchanging air flowing into the inside of the housing 10.

The housing 10 may include a main housing 11 in which the blowing unit 20 and the heat exchanger 30 are provided, and a front frame 16 patched on a front surface of the main housing 11. The housing 10 may include a first suction port 12, a second suction port 15, a first discharge port 17 and a second discharge port 13. A drain member 31 configured to collect condensed water generated in the heat exchanger 30 may be disposed at the lower end of the heat exchanger 30.

The main housing 11 may form a rear, a part of side surfaces, a part of an upper surface and a lower surface of the air conditioner 1. A front surface of the main housing 11 may be opened and the front frame 16 may be disposed on the front surface of the main housing 11. FIG. 2 illustrates that the front frame 16 is detachably disposed on the front frame 16 but the front frame 16 and the main housing 11 may be integrally formed with each other.

The front frame 16 may be disposed on a front upper side of the main housing 11, and a front panel 18 may be disposed on a front lower side of the main housing 11. The front panel 18 may cover at least a part of the front lower side of the opened-main housing 11.

The first discharge port 17 may be formed in the front frame 16. The first discharge port 17 may be disposed on the front surface of the housing 10. The first discharge port 17 may penetrate through the front frame 16. The first discharge port 17 may be disposed at a position substantially facing the first suction port 12. Air, which is heat-exchanged inside of the housing 10, may be discharged to the outside of the housing 10 through the first discharge port 17. The first discharge port 17 may discharge air, which is sucked through the first suction port 12.

The first suction port 12 may be disposed in the main housing 11. The first suction port 12 may penetrate a rear surface of the main housing 11. The first suction port 12 may be disposed on the upper portion of the rear surface of the main housing 11. External air may flow into the inside of the housing 10 through the first suction port 12.

Although FIG. 2 illustrates that three first suction ports 12 are provided, the number of the first suction ports 12 is not limited thereto, and thus various number of first suction port may be provided, as needed. Although FIG. 2 illustrates the first suction port 12 has a circular shape, the shape of the first suction port 12 is not limited thereto and thus the first suction port 12 may have a variety of shapes, as needed.

The second suction port 15 may be disposed in the main housing 11. The second suction port 15 may pass through the rear surface of the main housing 11. The second suction port 15 may be disposed at a lower portion of the rear surface of the main housing 11. The second suction port 15 may be disposed on the lower side of the first suction port 12. External air may flow into the inside of the housing 10 through the second suction port 15.

In the same manner as the first suction port 12, the number and/or shape of the second suction port 15 may vary as needed.

The second discharge port 13 may be disposed in the main housing 11. The second discharge port 13 may be disposed adjacent to the first discharge port 17. The second discharge port 13 may be disposed on at least one side of the main housing 11. The second discharge port 13 may penetrate the side surface of the main housing 11. The second discharge port 13 may be disposed on the upper portion of the side surface of the main housing 11. The second discharge port 13 may be disposed on opposite surfaces corresponding to a part of the housing 10 in which the first discharge port 17 is disposed.

The second discharge port 13 may be extended along a vertical direction of the main housing 11. The air, which is not heat-exchanged in the housing 10, may be discharged to the outside of the housing 10 through the second discharge port 13. The second discharge port 13 may be provided to discharge the air flowing through the second suction port 15.

The main housing 11 may be formed as one piece, or may be formed in two pieces in which upper lower portions are separated. According to an embodiment, the main housing 11 may be configured such that two pieces corresponding to upper lower portions are coupled to each other.

The second discharge port 13 may be configured to mix air discharged from the second discharge port 13 with air discharged from the first discharge port 17. Particularly, a part of the main housing 11, in which the second discharge port 13 is formed, may include a guide curved portion 13*a* (refer to FIG. 3) configured to guide air discharged from the second discharge port 13 so as to mix air discharged from the second discharge port 13 with the air discharged from the first discharge port 17.

The guide curved portion 13*a* may guide the air discharged from the second discharge port 13 by the Coanda effect. In other words, air discharged through the second discharge port 13 may be discharged along the guide curved portion 13*a* in a direction to allow to be mixed with the air discharged from the first discharge port 17. The guide curved portion 13*a* may guide the air discharged from the second discharge port 13 to the front side when the second discharge port 13 is disposed on the side surface of the housing 10 and the first discharge port 17 is disposed on the front surface of the housing 10.

A blade 61 (refer to FIG. 10) guiding air discharged through the second discharge port 13 may be disposed in the second discharge port 13. The blade 61 may be arranged continuously along a longitudinal direction of the second discharge port 13.

A flow path of air connecting the first suction port 12 and the first discharge port 17 is referred to as a first flow path S1 and a flow path of air connecting the second suction port 15 and the second discharge port 13 is referred to as a second flow path S2. The first flow path S1 and the second flow path S2 may be divided by an intermediate member 100. Accordingly, the air flowing through the first flow path S1 and the air flowing through the second flow path S2 may not be mixed.

The intermediate member 100 may include a guide portion 110 and a partition 120, wherein the guide portion 110 may be configured to cover a first blowing fan 22 in a circumferential direction of the first blowing fan 22 while being apart from an outer circumference surface of a first blowing fan 22 of a first blowing unit 21 to the outside of the outer circumference surface, and configured to guide air, which flows from the first suction port 12, to flow to the first blowing fan 22 while guiding air, which is blown by the first blowing fan 22, to the first discharge port 17, and the partition 120 may be extended from the outside of the guide portion 110 to an inner side surface 11*a* of the main housing 11 so as to divide between the first flow path S1 and the second flow path S2. The intermediate member 100 may include a blocking rib 140 configured to prevent air flowing from the first suction port 12 and air flowing from the second suction port 15 from being mixed with each other. A description thereof will be described later in detail.

The air conditioner 1 may be configured to discharge air, which is heat-exchanged by the heat exchanger 30, through the first discharge port 17 and configured to discharge air, which does not pass through the heat exchanger 30, through the second discharge port 13. That is, the second discharge port 13 may be configured to discharge air, which is not heat-exchanged. Since the heat exchanger 30 is disposed on the first flow path S1, the air discharged through the first discharge port 17 may be heat-exchanged air. Since the heat exchanger is not disposed on the second flow path S2, the air discharged through the second discharge port 13 may be air that is not heat exchanged.

Alternatively, according to the conventional manner, heat-exchange air may be discharged through the second discharge port 13. That is, the heat exchanger may also be disposed on the second flow path S2. Particularly, the heat exchanger, which is configured to exchange heat with air to be discharged through the second discharge port 13, may be disposed in an accommodating space 19 of the main housing 11. By using the above mentioned structure, the air conditioner 1 may provide heat-exchanged air through both the first discharge port 17 and the second discharge port 13.

The main housing 11 may be provided with a support stand 14. The support stand 14 may be disposed at the lower end of the main housing 11. The support stand 14 may stably support the housing 10 against the floor.

An accommodation space 19 in which electrical components (not shown) are disposed may be disposed in the main housing 11. The electrical components needed for driving the air conditioner 1 may be disposed in the accommodation space 19. A second blowing unit 26 may be disposed in the accommodation space 19.

The blowing unit 20 may include the first blowing unit 21 and the second blowing unit 26. The second blowing unit 26 may be driven independently of the first blowing unit 21. A rotational speed of the second blowing unit 26 may be different from a rotational speed of the first blowing unit 21.

The first blowing unit 21 may be disposed in the first flow path S1 disposed between the first suction port 12 and the first discharge port 17. Air may flow into the housing 10 through the first suction port 12 by the first blowing unit 21. The air flowing through the first suction port 12 may flow along the first flow path S1 and be discharged to the outside of the housing 10 through the first discharge port 17. The first blowing unit 21 may include the first blowing fan 22 and a first fan driver 23.

The first blowing fan 22 may be an axial-flow fan or a mixed-flow fan. However, the type of the first blowing fan 22 is not limited thereto, and thus as long as capable of blowing air, which flows from the outside of the housing 10, to be discharged to the outside of the housing 10, again, there may be no limitation in the type of the first blowing fan 22. For example, the first blowing fan 22 may be a cross fan, a turbo fan, or a sirocco fan.

Although FIG. 2 illustrates three first blowing fans 22, the number of the first blowing fan 22 is not limited thereto, and thus the number of the first blowing fan 22 may vary as needed.

The first fan driver 23 may drive the first blowing fan 22. The first fan driver 23 may be disposed at the center of the first blowing fan 22. The first fan driver 23 may include a motor.

The second blowing unit 26 may be disposed on the second flow path S2 disposed between the second suction port 15 and the second discharge port 13. Air may flow into the inside of the housing 10 through the second suction port 15 by the second blowing unit 26. The air, which flowing through the second suction port 15, may flow along the second flow path S2 and discharged to the outside of the housing 10 through the second discharge port 13.

The second blowing unit 26 may include a second blowing fan 27, a second fan driver 28, and a fan case 29.

The second blowing fan 27 may be a centrifugal fan. However, the type of the second blowing fan 27 is not limited thereto, and thus as long as capable of blowing air, which flows from the outside of the housing 10, to be discharged to the outside of the housing 10, again, there may be no limitation in the type of the first blowing fan 22. For example, the second blowing fan 27 may be a cross fan, a turbo fan, or a sirocco fan.

The fan case 29 may cover the second blowing fan 27. The fan case 29 may include a fan inlet 29*a* through which air flows and a fan outlet 29*b* through which air is discharged. A position in which the fan inlet 29*a* and the fan outlet 29*b* are disposed may be selected according to the type of the second blowing fan 27.

The heat exchanger 30 may be disposed between the first blowing unit 21 and the first discharge port 17. The heat exchanger 30 may be disposed on the first flow path S1. The heat exchanger 30 may absorb heat from air, which flows in through the first suction port 12, and transmit heat to the air, which flows in through the first suction port 12. The heat exchanger 30 may include a tube and a header coupled to the tube. However, the type of the heat exchanger 30 is not limited thereto.

The air conditioner 1 may include a discharge panel 40 disposed in a part of the front frame 16 on which the first discharge port 17 is disposed. A plurality of discharge holes may be disposed on the discharge panel 40 so that the air discharged from the first discharge port 17 is more slowly discharged than the air discharged from the second discharge port 13. The discharge panel 40 may be coupled to and supported by the front frame 16.

The plurality of discharge holes may penetrate the inner and outer surfaces of the discharge panel 40. The plurality of discharge holes may be formed in a finer size. The plurality of discharge holes may be uniformly distributed over the entire area of the discharge panel 40. The heat-exchanged air, which is discharged through the first discharge port 17 by the plurality of discharge holes, may be uniformly discharged at a low speed.

As for the housing 10, a rear housing 11*b* may be disposed in the rear side of the first suction port 12 of the main housing 11. Unlike an embodiment, the rear housing 11*b* may be integrally formed with the main housing 11. However, according to an embodiment, for the ease of assembly of components placed in the main housing 11, the main housing 11 and the rear housing 11*b* may be separately formed and then assembled with each other.

The rear housing 11*b* may include a first suction grill 51 disposed on the rear surface of the rear housing 11*b*. The first suction grill 51 may be configured to prevent foreign materials from entering into the first suction port 12. To this end, the first suction grill 51 may include a plurality of slits or holes. The first suction grill 51 may be provided to cover the first suction port 12.

The air conditioner 1 may include a second suction grill 52 coupled to a part of the main housing 11 in which the second suction port 15 is formed. The second suction grill 52 may be configured to prevent foreign materials from entering into the second suction port 15. To this end, the second suction grill 52 may include a plurality of slits or holes. The second suction grill 52 may be provided to cover the second suction port 15.

A first filter 51*a* may be disposed between the first suction grill 51 and the first suction port 12, and a second filter 52*a* may be disposed between the second suction grill 52 and the second suction port 15. The first filter 51*a* and the second filter 52*a* may be configured to prevent foreign materials, which are not filtered by the suction grills 51 and 52, from entering thereinto.

The first filter 51*a* and the second filter 52*a* may be removably inserted into the main housing 11, respectively.

Figure 3:
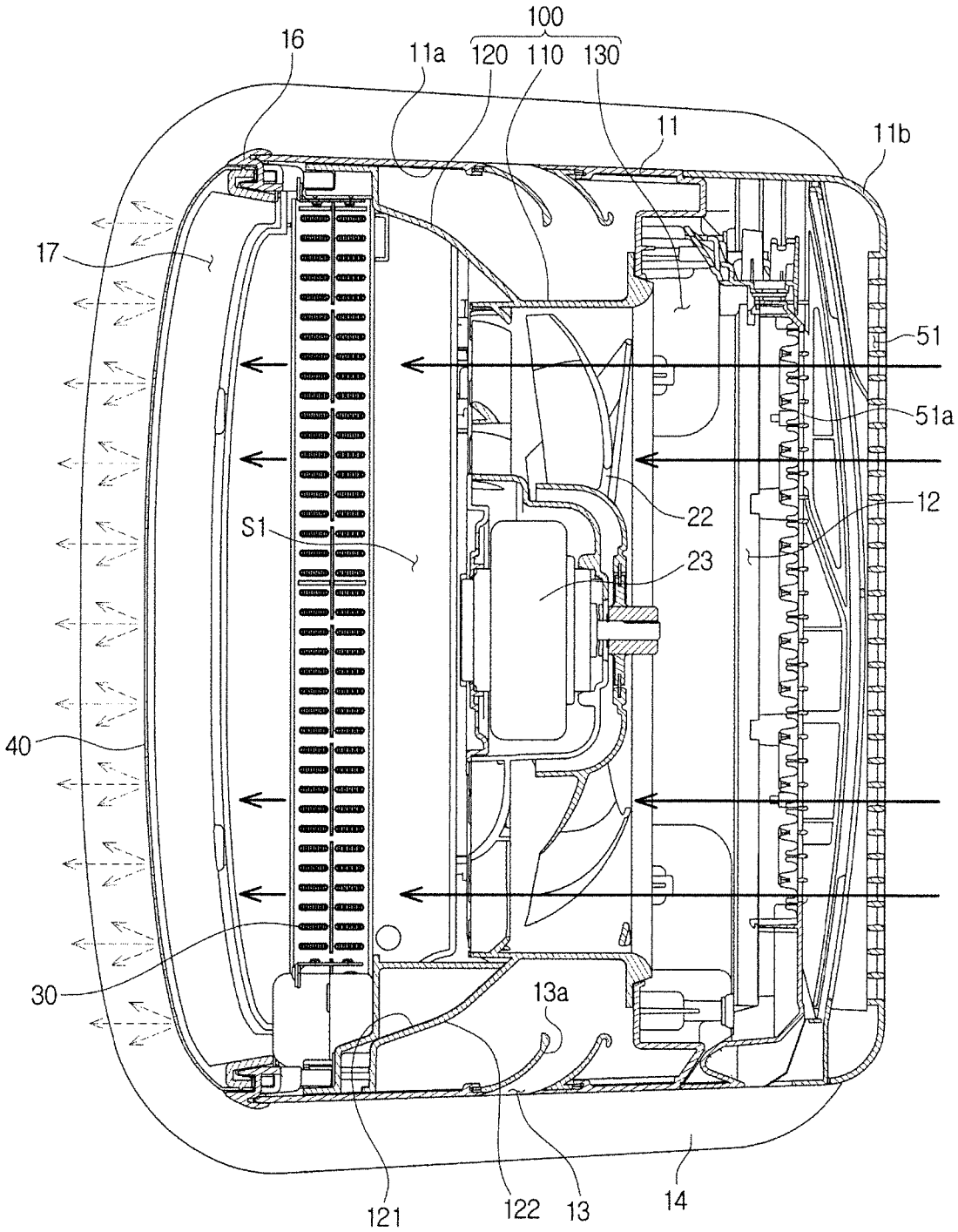
FIG. 3 is a cross-sectional view taken along the line A-A' shown in FIG. 1 when the air conditioner operates in the first mode.
Figure 4:
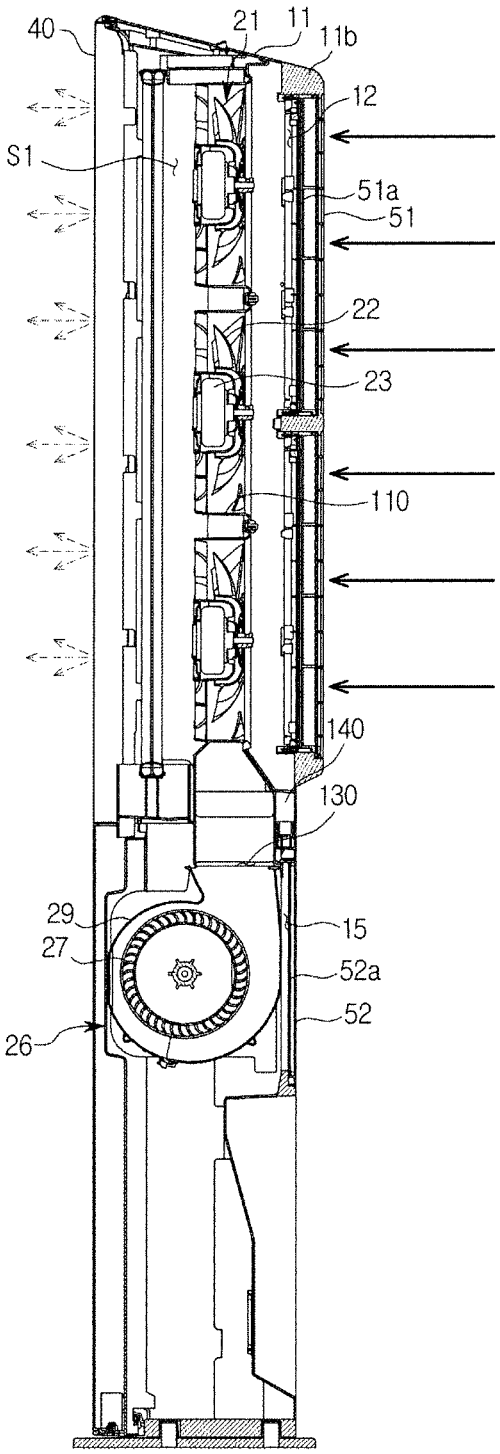
FIG. 4 is a cross-sectional view taken along line B-B' of FIG. 1 when the air conditioner operates in the first mode.
Figure 5:
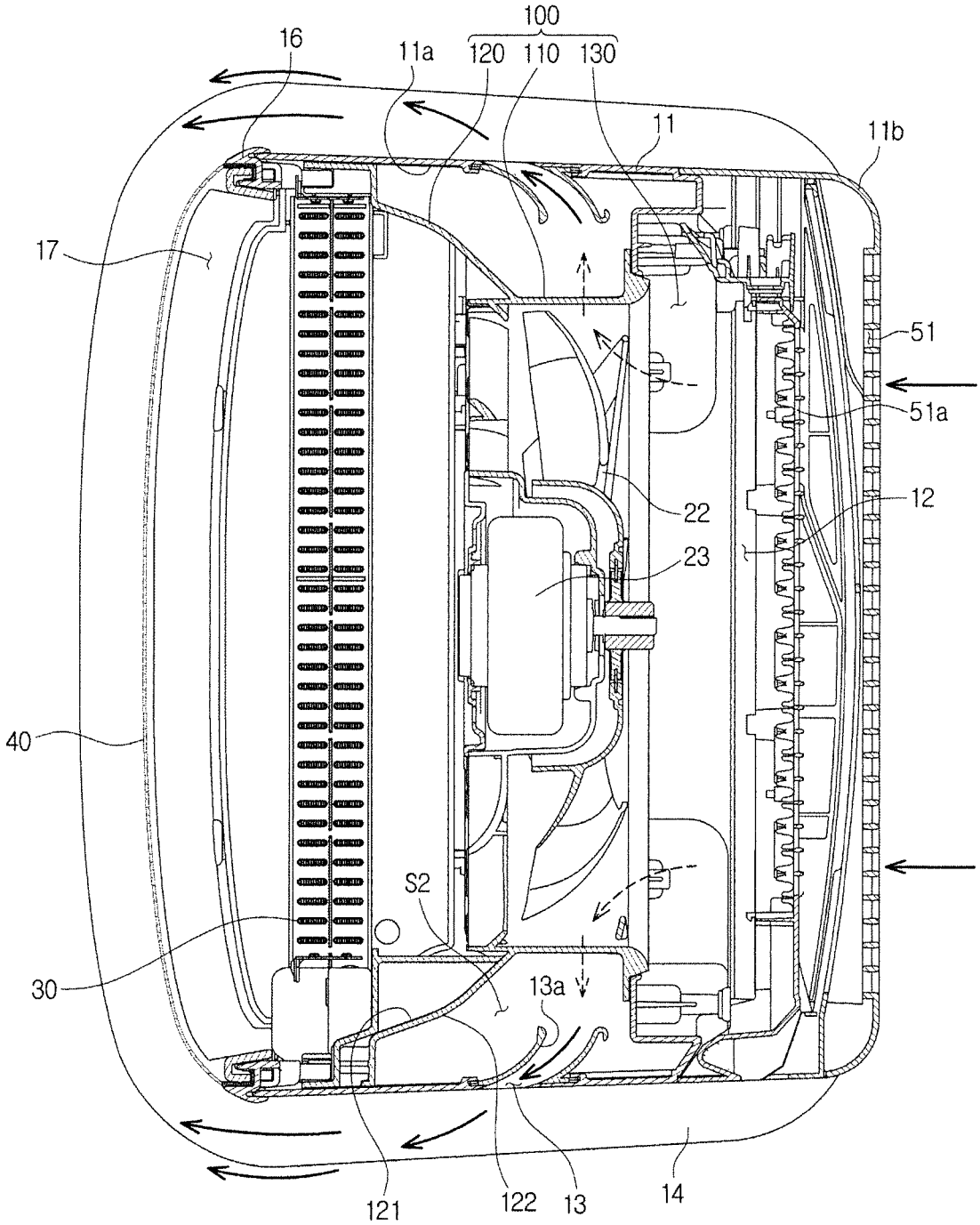
FIG. 5 is a cross-sectional view taken along the line A-A' shown in FIG. 1 when the air conditioner operates in the second mode.
Figure 6:
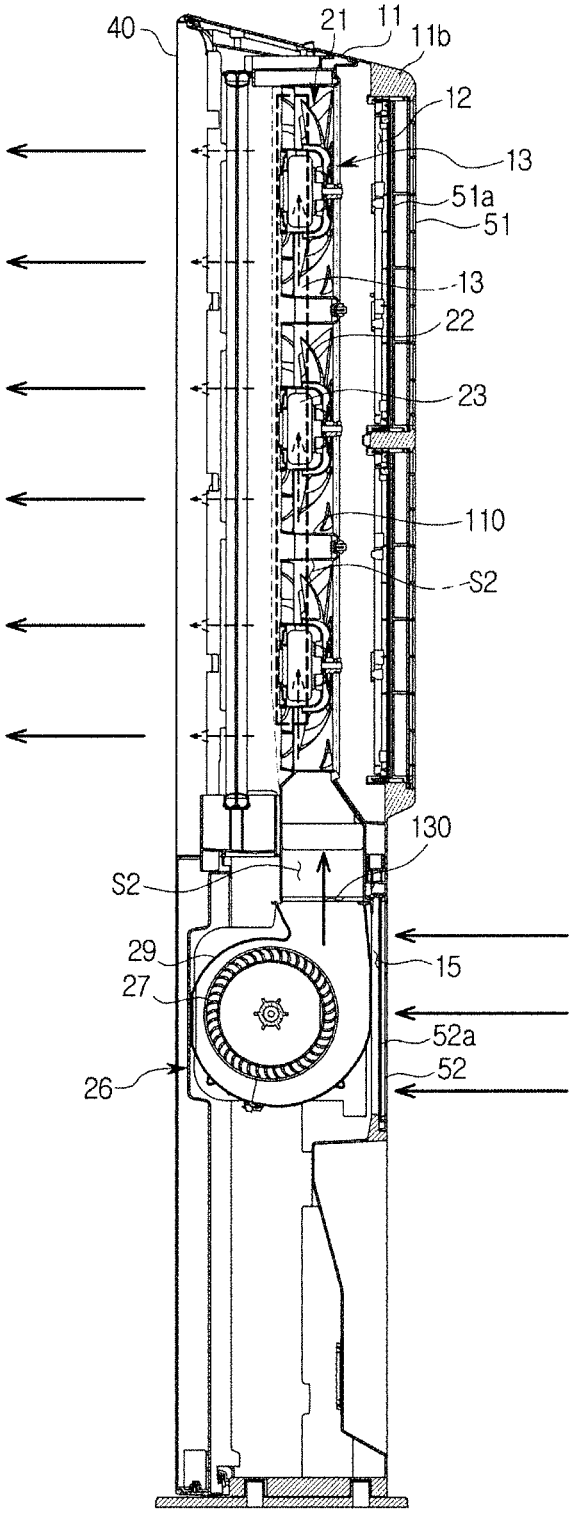
FIG. 6 is a cross-sectional view taken along line B-B' of FIG. 1 when the air conditioner operates in the second mode.
Figure 7:
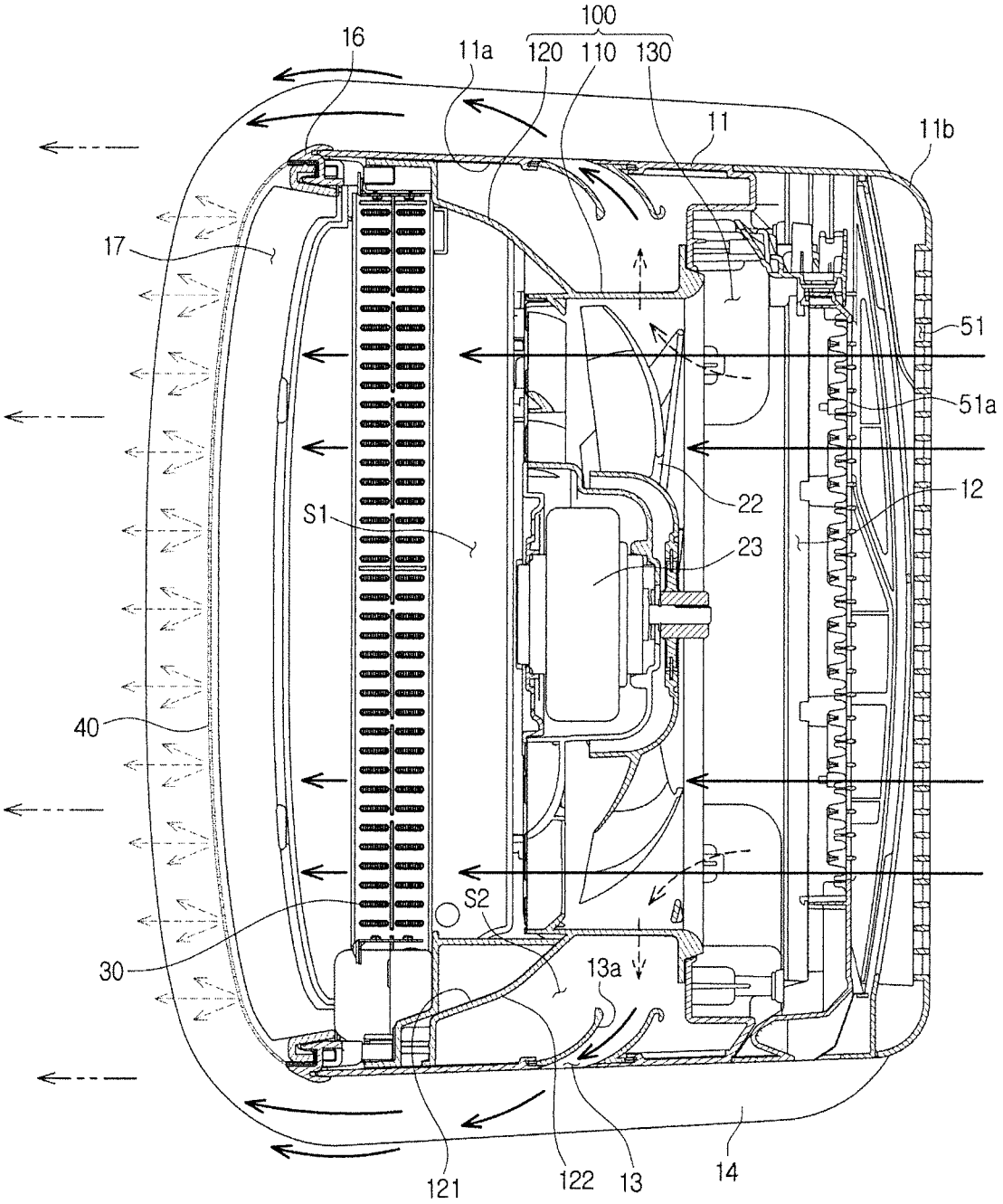
FIG. 7 is a cross-sectional view taken along line A-A' of FIG. 1 when the air conditioner operates in the third mode.
Figure 8:
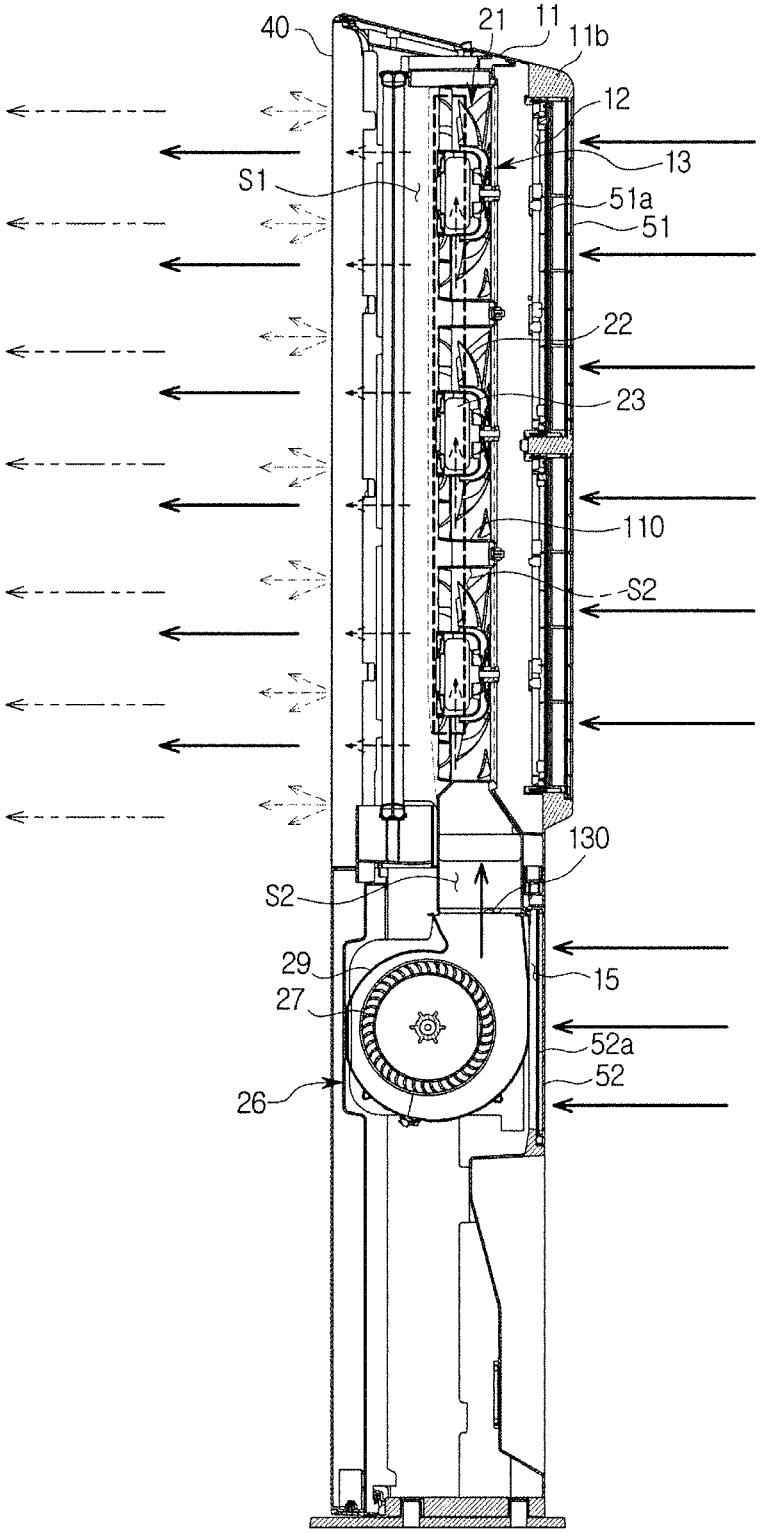
FIG. 8 is a cross-sectional view taken along line B-B' of FIG. 1 when the air conditioner in the third mode.

FIG. 3 is a cross-sectional view taken along A-A' of FIG. 1 in a state in which the air conditioner 1 of FIG. 1 is operated in a first mode. FIG. 4 is a cross-sectional view taken along B-B' of FIG. 1 in a state in which the air conditioner 1 of FIG. 1 is operated in the first mode. FIG. 5 is a cross-sectional view taken along A-A' of FIG. 1 in a state in which the air conditioner 1 of FIG. 1 is operated in a second mode. FIG. 6 is a cross-sectional view taken along B-B' of FIG. 1 in a state in which the air conditioner 1 of FIG. 1 is operated in the second mode. FIG. 7 is a cross-sectional view taken along A-A' of FIG. 1 in a state in which the air conditioner 1 of FIG. 1 is operated in a third mode. FIG. 8 is a cross-sectional view taken along B-B' of FIG. 1 in a state in which the air conditioner 1 of FIG. 1 is operated in the third mode.

Drive of the air conditioner 1 will be described with reference to FIGS. 3 to 8.

Referring to FIGS. 3 and 4, the air conditioner 1 may be operated in a first mode in which heat-exchanged air is discharged through only the first discharge port 17. Since the discharge panel 40 is disposed in the first discharge port 17, air conditioning may be performed slowly throughout a room. That is, when air is discharged to the outside of the housing 10 through the first discharge port 17, the speed of air may be reduced and discharged at a low speed while the air passes through the plurality of discharge holes of the discharge panel 40. With this configuration, the user can cool or heat the room with the speed of air for feeling comfortable.

Particularly, the outside air of the housing 10 may flow to the inside of the housing 10 through the first suction port 12 as the first blowing unit 21 is operated. The air flowing into the housing 10 may pass through the first blowing unit 21, and the heat-exchange be performed on the air as the air passes through the heat exchanger 30. The air, which is heat-exchanged by passing through the heat exchanger 30, may be discharged to the outside of the housing 10 through the first discharge port 17 in a state in which the speed of the air is reduced. That is, the heat-exchanged air, which is discharged through the first flow path S1, may be discharged at a low speed at which the user can feel comfort.

Since the second blowing unit 26 is not operated in the first mode, air is not discharged through the second discharge port 13.

Referring to FIGS. 5 and 6, the air conditioner 1 may be operated in the second mode in which air, which is not heat exchanged, is discharged only through the second discharge port 13. Since the heat exchanger is not disposed on the second flow path S2, the air conditioner 1 may circulate indoor air.

Since the second discharge port 13 is provided with the guide curved portion 13*a*, the air discharged through the second discharge port 13 may be discharged to the front side of the air conditioner 1. Since the blade 61 is provided on the second discharge port 13, the air may be blown further forward.

Particularly, the outside air of the housing 10 may flow the inside of the housing 10 through the second suction port 15 as the second blowing unit 26 is operated. The air flowing into the housing 10 may pass through the second blowing unit 26, and then flow into the second flow paths S2, which are disposed opposite sides of the first flow path S1, through the inlet 130 of the intermediate member 100, which is opened in the upper side and the lower side. The air may flow to the upper side on the second flow path S2 and be discharged to the outside of the housing 10 through the second discharge port 13. At this time, the air may be guided to the front side of the air conditioner 1 along the guide curved portion 13*a*.

Since the first blowing unit 21 is not operated in the second mode, air is not discharged through the first discharge port 17. That is, since the air conditioner 1 blows air, which is not heat-exchanged, in the second mode, the air conditioner 1 may perform a function of simply circulating indoor air or provide strong wind to a user.

Referring to FIGS. 7 and 8, the air conditioner 1 may be operated in the third mode in which heat-exchanged air is discharged through the first discharge port 17 and the second discharge port 13. The air conditioner 1 may discharge cold air further in the third mode, in comparison with the first mode.

Particularly, when air conditioner 1 is operated in the third mode, the cold air discharged through the first discharge port 17 may be mixed with cold air discharged through the second discharge port 13. In addition, since air discharged through the second discharge port 13 is discharged at a speed higher than a speed of air discharged through the first discharge port 17, the air discharged through the second discharge port 13 may move the cold air, which is discharged through the heat exchanger, further.

According to this configuration, the air conditioner 1 may provide the user with comfortable cold air in which cold air and room air are mixed.

In addition, the air conditioner 1 may be configured to change a driving force of the first blowing unit 21 and/or the second blowing unit 26 to provide cold air at various distances. That is, the first blowing unit 21 may be configured to regulate a volume and/or speed of the air discharged from the first discharge port 17, and the second blowing unit 26 may be configured to regulate a volume and/or speed of the air discharged from the second discharge port 13.

For example, when increasing the volume and/or speed of the air discharged from the second discharge port 13 by increasing the driving force of the second blowing unit 26, the air conditioner 1 may provide cold air relatively further. In contrast, when decreasing the volume and/or speed of the air discharged from the second discharge port 13 by decreasing the driving force of the second blowing unit 26, the air conditioner 1 may provide cold air at a relatively short distance.

Hereinafter, the intermediate member 100 will be described in detail.

Figure 9:
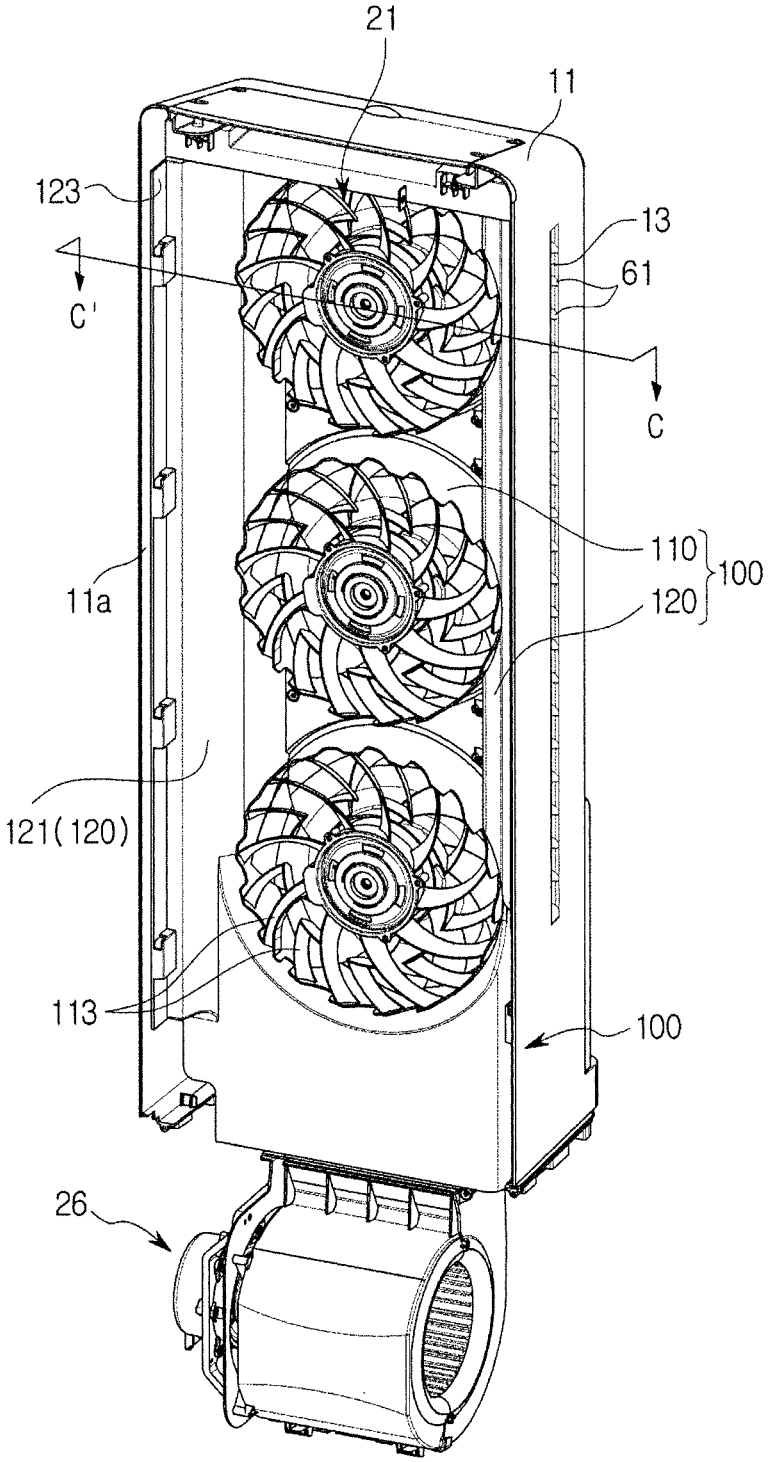
FIG. 9 is a perspective view of a part of the structure of an air conditioner according to an embodiment of the present disclosure.
Figure 10:
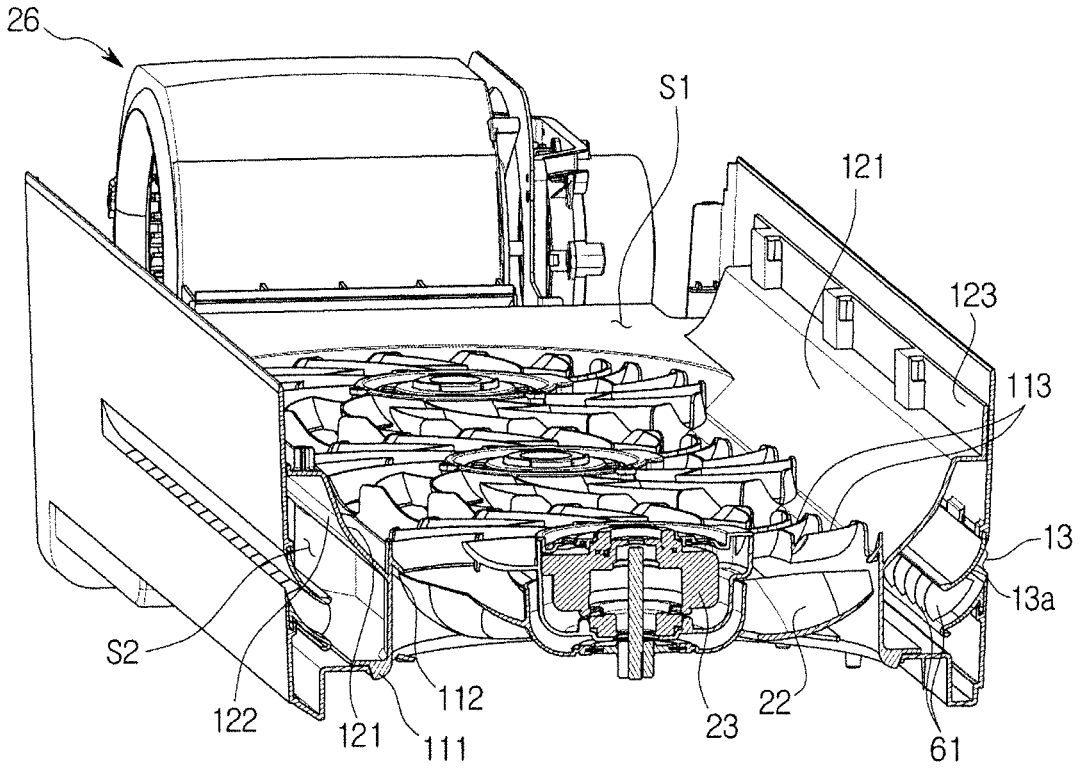
FIG. 10 is a cross-sectional perspective view showing a cross section taken along a line C-C' shown in FIG. 9

FIG. 9 is a perspective view of a part of a structure of the air conditioner according to an embodiment, and FIG. 10 is a cross-sectional perspective view taken along line C-C' of FIG. 9. For convenience of description, FIGS. 9 and 10 illustrate an upper portion of the main housing 11.

The intermediate member 100 may be disposed inside of the main housing 11. Particularly, the intermediate member 100 may be disposed between the upper surface of the main housing 11 and the second blowing unit 26 in a vertical direction while being disposed between the first blowing unit 21 and the heat exchanger 30 in a forward and backward direction.

The intermediate member 100 may be extended in a direction corresponding to the longitudinal direction of the main housing 11. That is, the intermediate member 100 may be extended in the vertical direction, wherein the vertical direction corresponds to the longitudinal direction.

The intermediate member 100 may include a guide portion 110 configured to cover the first blowing fan 22 in a circumferential direction of the first blowing fan 22 while being apart from an outer circumferential surface of the first blowing fan 22 of the first blowing unit 21 to the outside of the outer circumference surface, and configured to guide air, which flows from the first suction port 12, to flow to the first blowing fan 22 while guiding air, which is blown by the first blowing fan 22, to the first discharge port 17.

The guide portion 110 may include an opening facing the forward and backward direction. The guide portion 110 may be formed to correspond to the number of the first blowing fans 22. Therefore, according to an embodiment, three guide portions 110 may be provided.

The guide portion 110 may include a bell mouth portion 111 guiding the flow of air from the first blowing fan 22, and a diffuser portion 112 guiding air, which is blown by the first blowing fan 22, to the front side, and a plurality of discharge blades 113.

The bell mouth portion 111 may be disposed at the rear side of the guide portion 110 so as to guide the air, which flows from the first suction port 12, to the first blowing fan 22. The diffuser portion 112 may be extended forward from the bell mouth portion 111. The plurality of discharge blades 113 may be extended from the inner circumferential surface of the diffuser portion 112 to a direction of a rotation axis of the first blowing fan 22. The diffuser portion 112 may allow the air, which is blown by the first blowing fan 22, to flow forward, and the plurality of discharge blades 113 may guide a flow of discharged-air, which is blown forward, to flow toward a certain direction.

The intermediate member 100 may include the partition 120 configured to divide between the first flow path S1 and the second flow path S2. The partition 120 may be extended from the outside of the guide portion 110 to the inner side surface 11*a* of the main housing 11.

The partition 120 may be configured such that the air flowing in the first flow path S1 is discharged through the first discharge port 17 and the air flowing in the second flow path S2 is discharged through the second discharge port 13 without mixing the air in the first flow path S1 with the air in the second flow path S2. That is, the partition 120 may be configured to separate the flow path S1 from the second flow path S2 so that a section, in which each flow path S1 and S2 are communicated with each other, is not formed.

Therefore, the air in the first flow path S1 may be discharged to the outside of the housing 10 while the air flows from the first suction port 12 to the first discharge port 17 without being mixed with the air in the second flow path S2 in the housing 10. In the same manner, the air in the second flow path S2 may be discharged to the outside of the housing 10 without being mixed with the air in the first flow path S1 in the housing 10.

Particularly, since the partition 120 has a plate shape having a curved surface, the partition 120 may divide between the first flow path S1 and the second flow path S2. In other words, one surface 121 of the partition 120 may form a part of the first flow path S1 while the other surface 122 of the partition 120 may form a part of the second flow path S2.

The one surface 121 of the partition 120 may have a shape concave toward the inner side surface 11*a* of the main housing 11, so as to guide air, which is blown from the first blowing fan 22, to the side of the heat exchanger 30.

The other surface 122 of the partition 120 may have a shape convex toward the inner side surface 11*a* of the main housing 11, so as to guide air, which is blown from the second blowing unit 26, to the side of the second discharge port 13.

The partition 120 may include a contact portion 123 provided at an end of the partition 120 and configured to be in contact with the inner side surface 11*a* of the main housing 11.

By contacting with the inner side surface 11*a* of the main housing 11 without a space, the contact portion 123 may seal between the first flow path S1 and the second flow path S2 and sufficiently separate between the first flow path S1 and the second flow path S2.

The intermediate member 100 may include the inlet 130 opened in the vertical direction and configured to be communicated with the second blowing fan 26 at a lower end thereof. The inlet 130 may guide the air, which is sucked through the second suction port 15, to the second flow path S2 by moving the air, which is blown from the second blowing unit 26, to the second flow path S2.

As mentioned above, the intermediate member 100 may guide the air on the first flow path S1 and the second flow path S2 and separate between the first flow path S1 and the second flow path S2 so as to prevent the air on the first flow path S1 and the air on the second flow path S2 from being mixed with each other.

The intermediate member 100 may form the first flow path S1 and the second flow path S2. Particularly, the first flow path S1 may be formed in a space defined by the guide portion 110 and the one surface 121 of the partition 120, and the second flow path S2 may be formed in a space defined by the inner side surface 11*a* of the main housing 11 and the other surface 122 of the partition 120.

In the conventional manner, as for an air conditioner provided with two or more flow paths in a housing thereof, a separate additional component may be required to dispose each flow path. Accordingly, the inner space of the housing may be increased and it may lead to the increase of the volume of the air conditioner. Therefore, it may cause of increasing of the material cost or reduction in the efficiency of the assembly. In addition, since the flow path is formed by the additional component, an impact is continuously applied to the assembly structure of the additional component due to the flow of air on the flow path, thereby causing vibration or noise.

However, according to an embodiment, the air conditioner is provided with the first flow path S1 and the second flow path S2, which are formed by the intermediate member 100, and thus the plurality of flow paths S1 and S2 may be disposed inside of the housing 10 without a separate configuration.

That is, since the first flow path S1 is formed by the guide portion 110 of the intermediate member 100, the one surface 121 of the partition 120, and at least one portion of an inner surface of the main housing 11, and the second flow path S2 is formed by the other one surface 122 of the partition 120, and the inner side surface 11*a* of the main housing 11, it may be possible to form the first flow path S1 and the second flow path S2 by the intermediate member 100 and the housing 10 without a separate configuration.

Particularly, the plurality of flow paths may be formed by a single component such that the first flow path S1 and the second flow path S2 are separately formed by the partition 120 extending to the outside of the guide portion 110. In the conventional manner, other than a cylindrical molded object including a bell mount portion and a diffuser portion forming a main flow path, an additional component may be provided to form a second flow path corresponding to an auxiliary flow path. However, according to an embodiment, since the partition 120 forming the second flow path S2 is integrally formed with the guide portion 110 corresponding to the bell mouth portion and the diffuser portion, it may be possible to form two flow paths S1 and S2 without an additional component.

Accordingly, since the additional component is not provided in the housing 10 of the air conditioner 1 according to an embodiment, it may be possible to reduce the volume of the air conditioner, and to reduce the vibration and noise caused by the flow of the air in the flow path, in comparison with the air conditioner provided with the plurality of flow paths according to the conventional manner.

Hereinafter, an air conditioner according to another embodiment of the present disclosure will be described. Except components such as an intermediate member 100' and, a suction port 12', components of the air conditioner according to another embodiment may be the same as the components according to an embodiment, and thus a description of the components according to another embodiment will be omitted.

Figure 11:
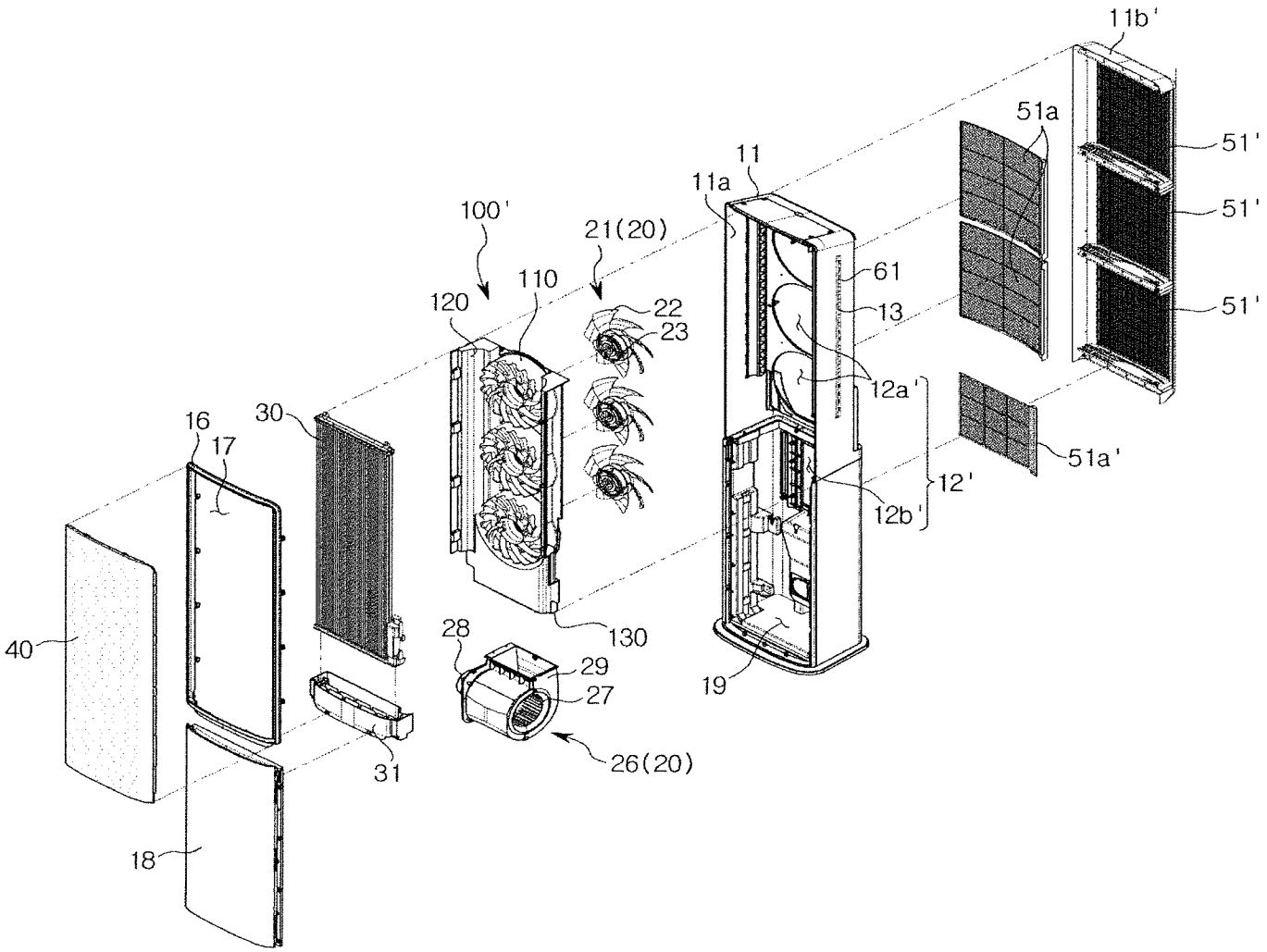
FIG. 11 is an exploded perspective view of an air conditioner according to another embodiment of the present disclosure.
Figure 12:
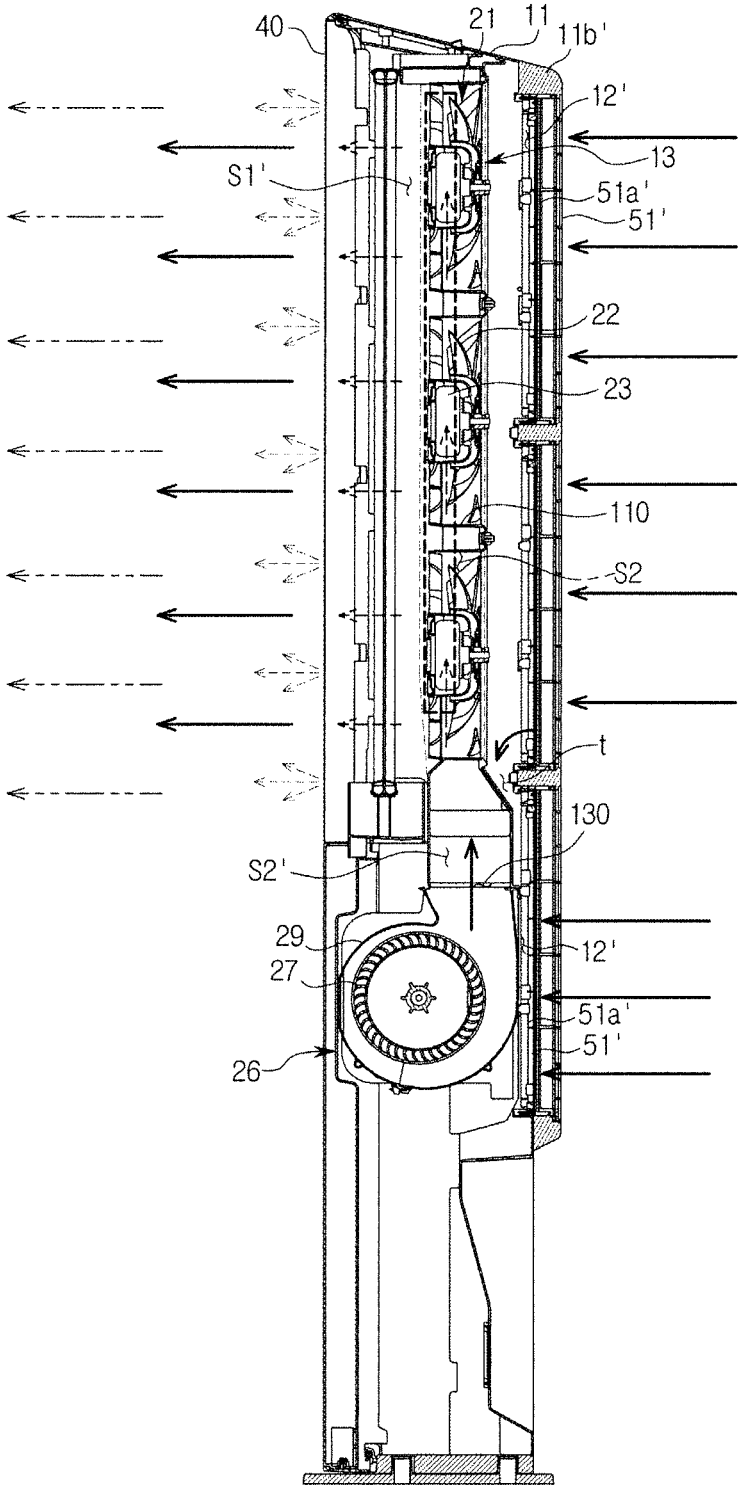
FIG. 12 is a view showing a cross section when the air conditioner shown in FIG. 11 when the air conditioner operates in the third mode.

FIG. 11 is an exploded perspective view of an air conditioner according to another embodiment, and FIG. 12 is a cross-sectional view of the air conditioner of FIG. 11 in a state in which the air conditioner 1 of FIG. 11 is operated in the third mode.

As illustrated in FIGS. 11 and 12, a suction portion 12' may be provided on a rear surface of the main housing 11. As illustrated in the drawings, four suction ports 12*a*', and 12*b*' may be provided, but is not limited thereto. Alternatively, a single suction port 12' may be provided or the number of the suction port may vary as needed.

That is, according to an embodiment, the air conditioner includes the first suction port 12 and the second suction port 15 separately, wherein the air conditioner includes the first flow path S1 communicating between the first suction port 12 and the first discharge port 17, and the second flow path S2 communicating between the second suction port 15 and the second discharge port 13. The intermediate member 100 is configured to divide between the suction ports 12 and 15, and between the discharge ports 13 and 17 so as to completely block between the first flow path S1 and the second flow path S2.

However, according to another embodiment, as for the air conditioner, the suction port 12' may be commonly formed so that both of a first flow path S1' and a second flow path S2' are communicated with the single suction port 12'.

Air, which is sucked through any one suction port 12a' disposed in an upper side, among a plurality of suction ports 12a' and 12b' as illustrated in the drawings, may flow to the second blowing unit 26 disposed inside of the main housing 11 and then discharged to the second discharge port 13 along the second flow path S2.

That is, air may be sucked through any one suction port 12a' in the upper side, as well as a suction port 12b' disposed in a lower side adjacent to the second blowing unit 26. The intermediate member 100' according to another embodiment may be disposed to form a space t, wherein the space t may be disposed between the main housing 11 and the intermediate member 100' and configured to allow air, which is sucked from the suction port 12', to flow in the vertical direction, which is different from the intermediate member 100 according to an embodiment.

According to an embodiment, the intermediate member 100 (refer to FIGS. 2 and 4) may include the blocking rib 140 extended to the rear side of the intermediate member 100 so as to completely divide between the first flow path S1 and the second flow path S2 by blocking between the first suction port 12 and the second suction port 15.

The blocking rib 140 may be extended from the intermediate member 100 to be in contact with the main housing 11 so as to block between the first suction port 12 and the second suction port 15. Accordingly, it may be possible to prevent that the air, which is sucked from the first suction port 12, flows to the second blowing unit 26 or it may be possible to prevent that the air, which is sucked from the second suction port 15, flows to the first blowing unit 21.

However, according to another embodiment, since the intermediate member 100' is not provided with the blocking rib 140, the air may flow to the first blowing unit 21 or the second blowing unit 26 through the space t, regardless of whether the air is sucked through the suction port 12a' or the suction port 12b'.

A rear housing 11b' may include a suction grill 51' disposed on the rear surface of the rear housing 11b'. The suction grill 51' may be configured to prevent foreign materials from entering into the suction port 12'. To this end, the suction grill 51' may be disposed to correspond to the suction ports 12a' and 12b'.

A filter 51a' may be disposed between the suction grill 51' and the suction port 12'. The filter 51a' may be configured to prevent foreign materials, which are not filtered by the suction grill 51', from entering thereinto. The filter 51a' may be removably inserted into the main housing 11.

Hereinafter, an air conditioner according to still another embodiment of the present disclosure will be described. Except components such as an inlet 130' and, a third suction port 13', components of the air conditioner according to still another embodiment may be the same as the components according to an embodiment, and thus a description of the components according to another embodiment will be omitted.

Figure 13:
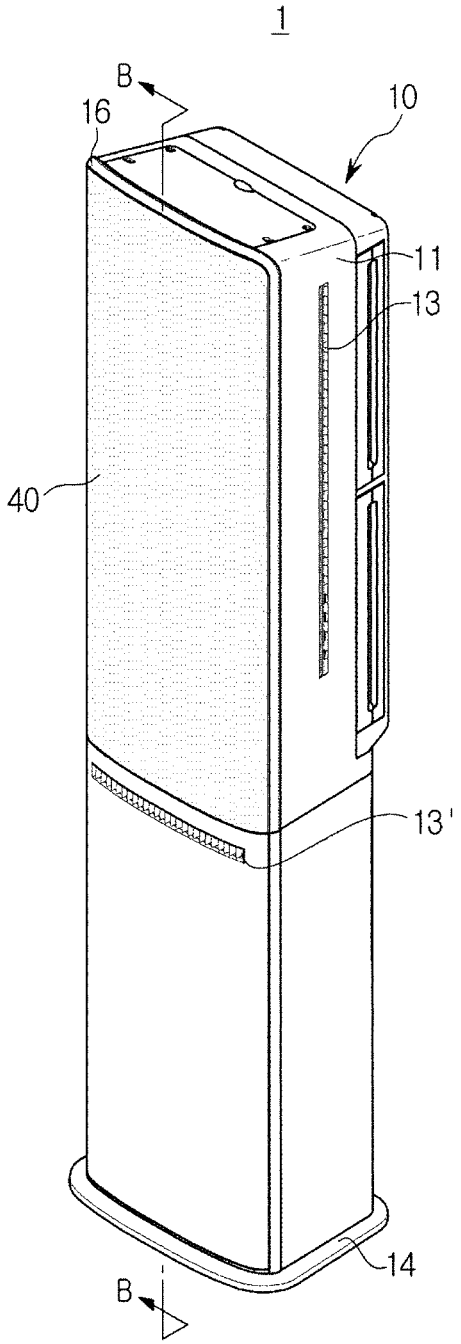
FIG. 13 is a perspective view of an air conditioner according to another embodiment of the present disclosure.
Figure 14:
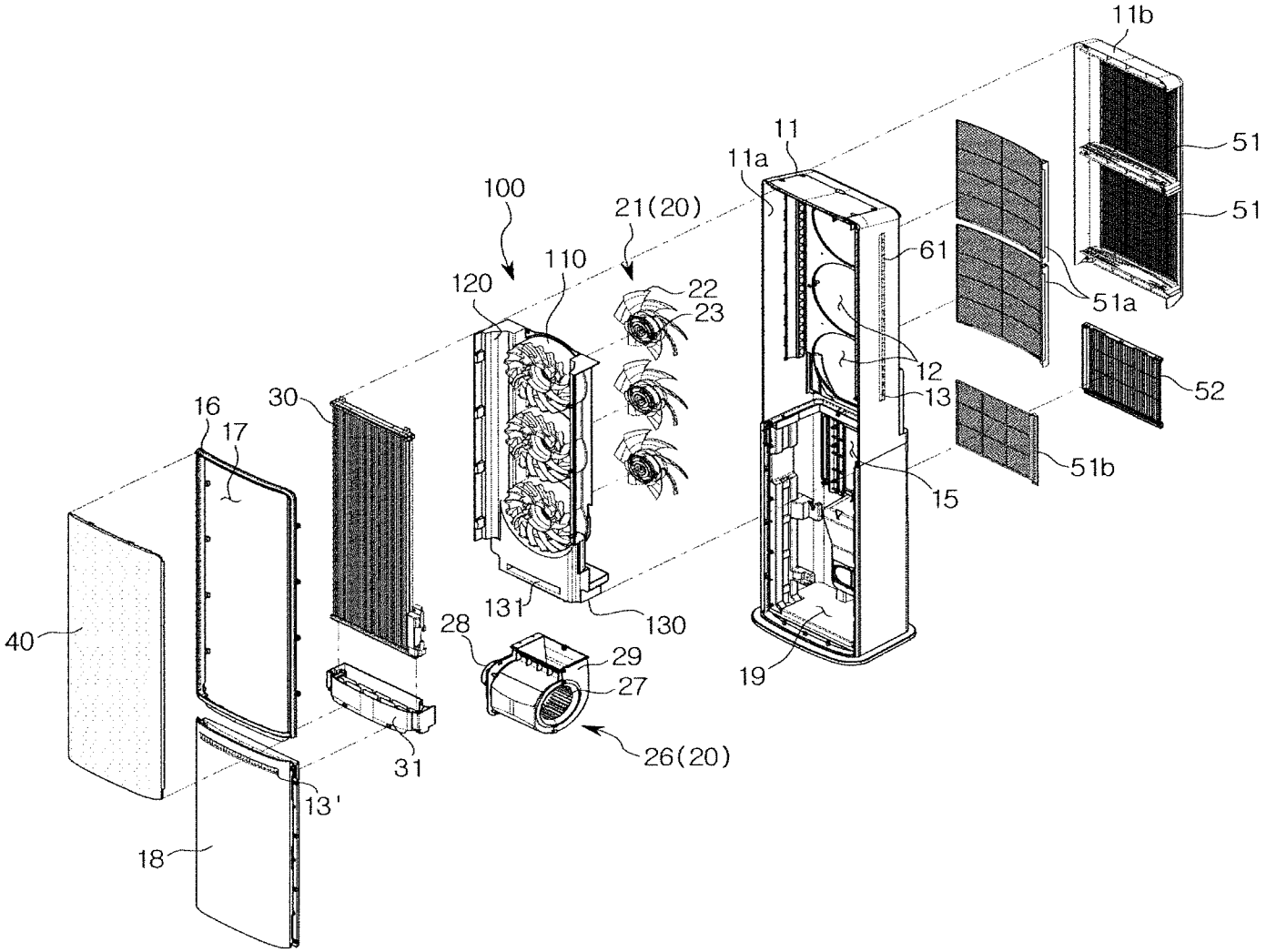
FIG. 14 is an exploded view of the air conditioner shown in FIG. 13.
Figure 15:
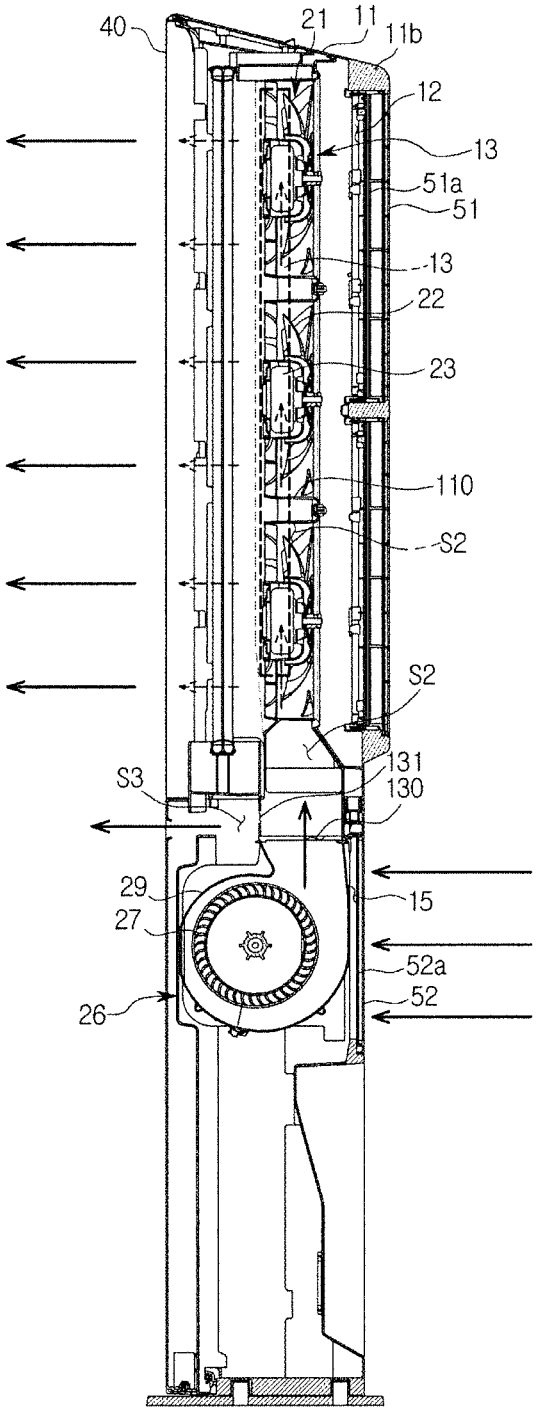
FIG. 15 is a view showing a cross section when the air conditioner shown in FIG. 13 operates in the second mode.

FIG. 13 is a perspective view of an air conditioner according to still another embodiment, FIG. 14 is an exploded view of the air conditioner of FIG. 13, and FIG. 15 is a cross-sectional view of the air conditioner of FIG. 13 in a state in which the air conditioner 1 of FIG. 13 is operated in the second mode.

As illustrated in FIGS. 13 and 14, the air conditioner 1 may further include a third discharge port 13' configured to discharge air to the front side.

In the same manner as the air discharged from the second discharge port 13, air, which is discharged from the third discharge port 13', may correspond to air, which is discharged by the second blowing unit 26 along the second flow path S2 without passing through the heat exchanger 30.

That is, the air conditioner 1 may include a third flow path S3 communicated with the second flow path S2 and the third discharge port 13'. Some amount of air flowing in the second flow path S2 may flow in the third flow path S3 communicated with the second flow path S2, and the air, which flows in the third flow path S3, may be discharged through the third discharge port 13'.

In front of the inlet 130', a connecting slit 131 may be disposed to form the third flow path S3. Some amount of the air flowing through the second flow path S2 may flow into the third flow path S3 through the connecting slit 131.

As illustrated in FIG. 15, air, which is not heat-exchanged, may be discharged through the second discharge port 13, and the third discharge port 13' when the air conditioner 1 is operated in the second mode.

Since together with the second discharge port 13, the third discharge port 13' is configured to discharge air to the front side, the air conditioner 1 according to another embodiment may discharge greater amount air to the front side and discharge the air further forward, in comparison with the air conditioner 1 according to an embodiment.

Therefore, since the air discharged from the first discharge port 17 and the air discharged from the third discharge port 13' are mixed when the air conditioner 1 is operated in the third mode, the heat-exchanged air discharged from the first discharge port 17 may be discharged further forward.

The installation of the third discharge port 13' is not limited to another embodiment, but the third discharge port 13' may be disposed in the upper side of the first discharge port 17. The third flow path S3 may be communicated with the upper side of the second flow path S2 and deliver the air to the third discharge port 13' disposed in the upper side. In addition, the single third discharge port 13' may be provided in the upper and lower side of the first discharge port 17.

Alternatively, the air conditioner 1 may only include the third discharge port 13' without the second discharge port 13. Therefore, the air conditioner 1 may discharge comfortable cold air in which heat-exchanged air are indoor air are mixed with each other, in various directions and in a various distance since the air discharged from the third discharge port 13' is mixed with the air discharged from the first discharge port 17.

Hereinafter an air conditioner according to still another embodiment will be described. Except components such as a second blowing unit 26', components of the air conditioner according to still another embodiment may be the same as the components according to an embodiment, and thus a description of the components according to another embodiment will be omitted.

Figure 16:
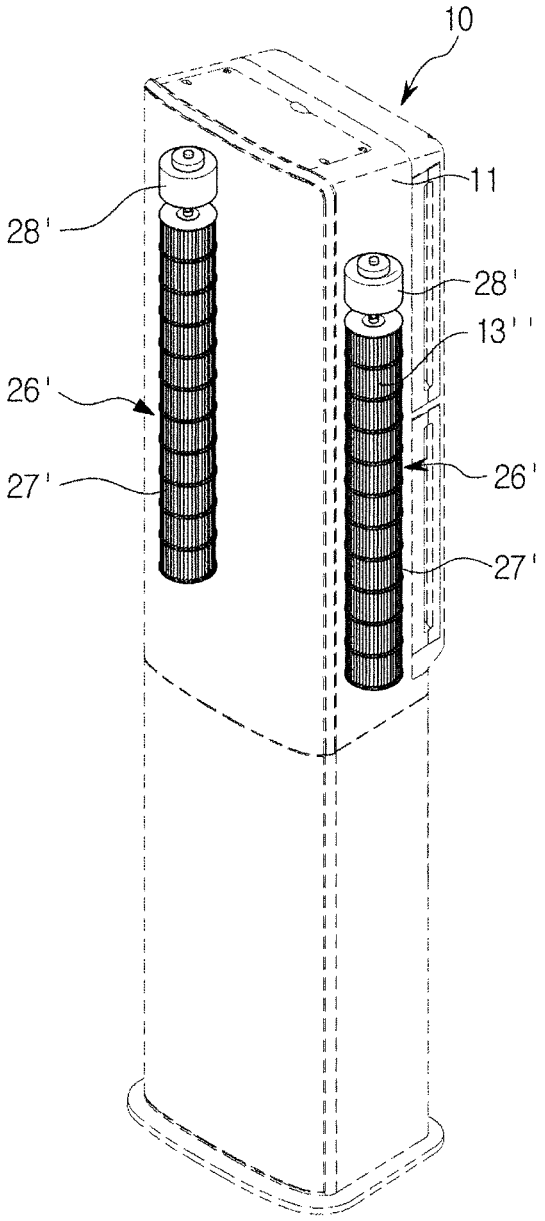
FIG. 16 is a view showing a part of an air conditioner according to another embodiment of the present disclosure.
Figure 17:
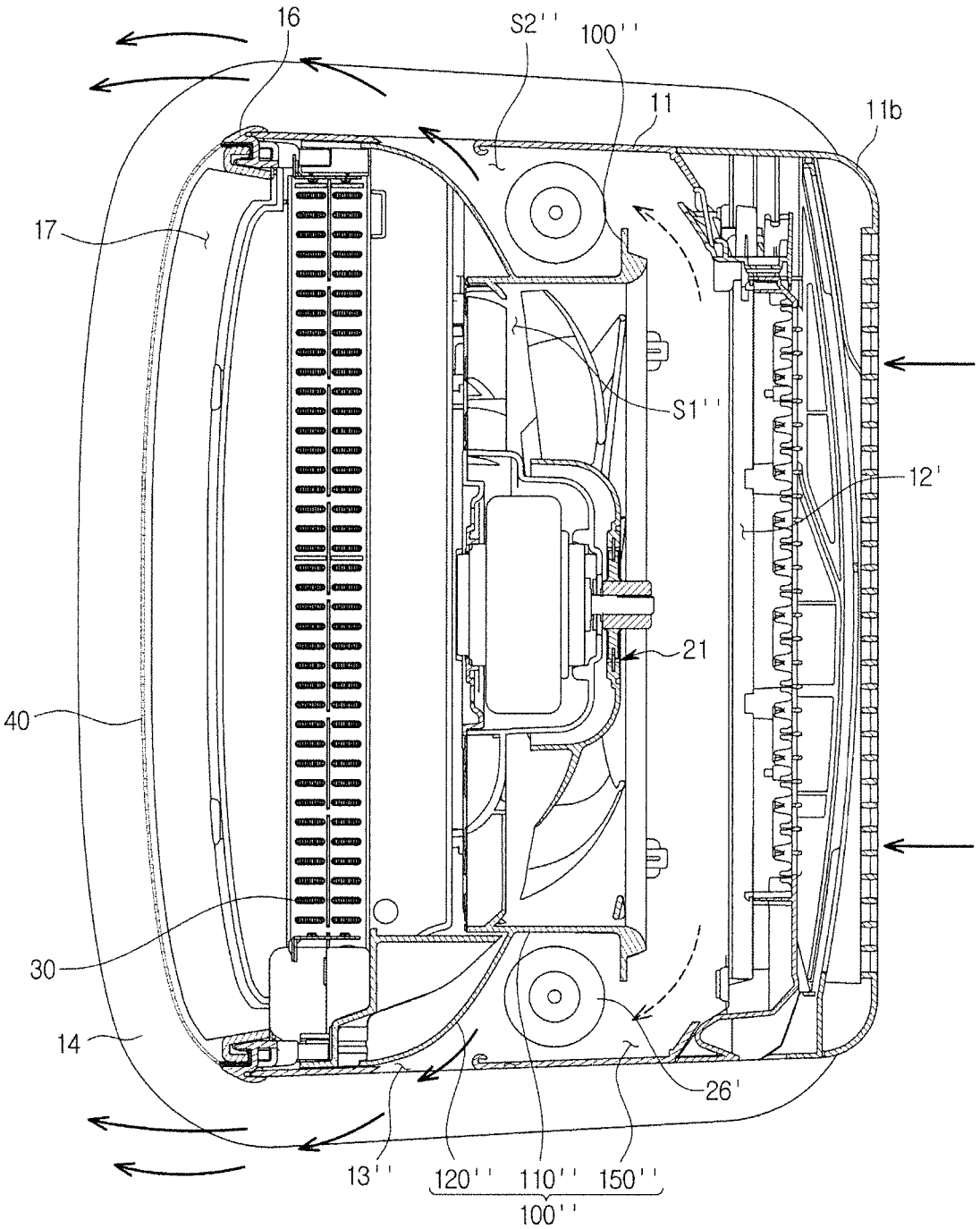
FIG. 17 is a view showing a cross section when the air conditioner shown in FIG. 16 operates in the second mode

FIG. 16 is a view of a component of an air conditioner according to still another embodiment, and FIG. 17 is a cross-sectional view of the air conditioner of FIG. 16 in a state in which the air conditioner 1 of FIG. 16 is operated in the second mode.

Referring to FIGS. 16 and 17, the air conditioner 1 may include a second blowing unit 26' disposed on the upper side of the main housing 11. The second blowing unit 26' may be a cross-flow fan.

The second blowing unit may be disposed on the left and right side of the main housing 11, respectively. The second blowing unit 26' may include a second blowing fan 27' and a second fan driver 28' connected to one end of the second blowing fan 27'

As mentioned above, the second blowing unit 26' may be disposed on the upper left and the upper right side of the inside of the main housing 11 in which the second discharge port 13 is disposed. In this case, air may be supplied to the first blowing unit 21 and the second blowing unit 26' through the suction port 12' in which the first suction port 12 and the second suction port 15 are integrated without being separated, which is different from an embodiment.

That is, according to still another embodiment, the suction port 12' of the air conditioner 1 is may be disposed on the upper side of the main housing 11 or the suction port 12' may be not disposed on the lower side of the main housing 11. However, alternatively, an additional suction port may be disposed in the lower side of the main housing 11 to increase an amount of sucked air.

An intermediate member 100" may include a suction opening 150" configured to allow air to flow to a second flow path S1". The suction opening 150" may be disposed in the rear side of the intermediate member 100", and the suction opening 150" may be formed such that at least one part of the rear surface of the intermediate member 100" is slit. Therefore, at least some amount of air, which is sucked from the suction port 12', may flow into the second flow path S" through the suction opening 150".

Accordingly, some amount of the air, which is sucked from the suction port 12', may flow along a first flow path S1" by the first blowing unit 21, and some amount of the air, which is sucked from the suction port 12', may flow to the second flow path S" through the suction opening 150".

The second flow path S" may be provided in an inner space formed among the intermediate member 100", a side surface of the main housing 11 and the suction opening 150". In the second flow path S", the second blowing unit 26' configured to move air in the second flow path S" may be disposed.

The second blowing unit 26' may move air so that air sucked through the suction opening 150" is discharged through a second discharge port 13". The air sucked through the suction opening 150" may be guided by the other surface of a partition 120" without an additional guide by a guide curved portion, and then discharged to the second discharge port 13".

The partition 120" may include a curved surface and be configured to allow air, which is blown from the second blowing unit 26', to be guided to the second discharge port 13" along the curved surface.

As is apparent from the above description, the air conditioner is capable of having a variety of having various air discharging methods since the air conditioner is provided with the first discharge port having the discharge panel having the plurality of discharge holes, and the second discharge port configured to blow natural wind.

The air conditioner is capable of cooling and heating the room with at a minimum wind speed at which a user feels comfortable, since the air conditioner is provided with a first discharge port having the discharge panel having the plurality of discharge holes.

The air conditioner is capable of providing natural winds in which air is not heat exchanged, since the air conditioner discharges air through the second flow path on which the heat exchanger is not disposed.

The air conditioner is capable of providing air in which heat-exchanged air and room air are mixed with each other, since the air conditioner is provided with the guide curved portion configured to guide air, which is discharged through the second discharge port, to allow the air, which is discharged through the second discharge port, to be mixed with air, which is discharged through the first discharge port.

The air conditioner is capable of having a structure in which a flow path, in which heat-exchanged air flows, and a flow path, in which natural winds flows, are effectively arranged and thus it is possible to reduce the size of the body of the air conditioner.

Although a few embodiments of the present disclosure have been shown and described, it would be appreciated by those skilled in the art that changes may be made in these embodiments without departing from the principles and spirit of the disclosure, the scope of which is defined in the claims and their equivalents.

| Description symbols | |
|---|---|
| 1; air conditioner | 10; housing |
| 11; main housing | 12; first suction port |
| 13; second discharge port | 13a; guide curved portion |
| 15; second suction port | 17; first discharge port |
| 21; first blowing unit | 26; second blowing unit |
| 40; discharge panel | 100; intermediate member |
| 110; guide portion | 111; bell mouth portion |
| 112; diffuser portion | 120; partition |
| 121; one surface | 122; other surface |
| 123; contact portion | 130; inlet |
| S1; first flow path | S2; second flow path |

What is claimed is:

1. An air conditioner comprising:

a housing;

a first suction port disposed in the housing;

a second suction port disposed in the housing;

a first discharge port disposed in the housing;

a second discharge port disposed in the housing;

a heat exchanger;

a first fan configured to cause air to be sucked through the first suction port to be discharged through the first discharge port;

a second fan configured to cause other air to be sucked through the second suction port to be discharged through the second discharge port; and an intermediate member configured to guide the air caused to be sucked through the first suction port by the first fan to the first fan, and from the first fan to the heat exchanger, and to guide the other air caused to be sucked through the second suction port by the second fan to the second discharge port to be discharged through the second discharge port, without the other air passing through the heat exchanger.

2. The air conditioner of claim 1, wherein the intermediate member comprises a guide portion configured to form at least part of a first flow path for the air caused to be sucked through the first suction port to flow to the first discharge port, and configured to guide air in the first flow path to the heat exchanger; and a partition configured to divide between the first flow path and a second flow path for the other air caused to be sucked through the second suction port by the second fan to flow to the second discharge port.

3. The air conditioner of claim 1, wherein the intermediate member comprises a guide portion configured to form at least part of a first flow path for the air caused to be sucked through the first suction port by the first fan to flow to the first discharge port, and configured to guide the air in the first flow path to the heat exchanger; and a partition configured to divide between the first flow path and a second flow path for the other air caused to be sucked through the second suction port by the second fan to flow to the second discharge port.

4. The air conditioner of claim 3, wherein the first discharge port is disposed on a front surface of the housing and the second discharge port is disposed on a side surface of the housing, and the partition extends from an outside of the guide portion to the side surface of the housing.

5. The air conditioner of claim 4, wherein a side end portion of the partition is in contact with an inner side surface of the housing to divide between the first flow path and the second flow path.

6. The air conditioner of claim 4, wherein one surface of the partition guides the air which is caused to be sucked through the first suction port by the first fan, to the first discharge port, and another surface of the partition guides the other air, which is caused to be sucked through the second suction port by the second fan, to the second discharge port.

7. The air conditioner of claim 6, wherein the first flow path is formed by the guide portion and the one surface of the partition, and the second flow path is formed by an inner side surface of the housing and the another surface of the partition.

8. The air conditioner of claim 3, wherein the guide portion comprises:

a bell mouth portion configured to guide the air, which is caused to be sucked through the first suction port by the first fan, to flow to the first fan; and a diffuser portion configured to guide the air, which is blown by the first fan, to flow to the heat exchanger.

9. The air conditioner of claim 4, wherein:

the second fan is disposed between the second suction port and the intermediate member the intermediate member further comprises an inlet disposed in a lower portion of the intermediate member and configured to be opened in a vertical direction to allow the other air to flow thereinto, and the guide portion is configured to be opened in a frontward and backward direction, such that the air caused to be sucked through the first suction port by the first fan is guided to the first fan and is guided from the first fan to the heat exchanger.

10. The air conditioner of claim 4, further comprising:

a discharge panel disposed at a front side of the first discharge port and provided with a plurality of discharge holes.

11. The air conditioner of claim 10, further comprising:

a guide curved portion configured to guide the other air, which is discharged through the second discharge port, to a front side of the air conditioner so that the other air, which is discharged through the second discharge port, is mixed with the air which is discharged through the first discharge port.

12. The air conditioner of claim 11, wherein the second fan is configured to cause the other air to be discharged through the second discharge port at a speed faster than a speed of the air discharged through the discharge panel.

13. The air conditioner of claim 4, further comprising:

a third discharge port disposed on at least one of an upper side and a lower side of the first discharge port, wherein a third flow path communicating between the second flow path and the third discharge port is disposed between the second flow path and the third discharge port.

14. The air conditioner of claim 2, further comprising:

a guide curved portion configured to guide the other air, which is discharged through the second discharge port, to a front side of the air conditioner so that the other air, which is discharged through the second discharge port, is mixed with the air, which is discharged through the first discharge port.

15. An air conditioner comprising:

a housing having a first suction port and a second suction port;

a first discharge port disposed in the housing;

a second discharge port disposed in the housing;

an intermediate member including a partition configured to divide between a first flow path for air sucked through the first suction port to flow to the first discharge port and a second flow path for air sucked through the second suction port to flow to the second discharge port, and a guide portion configured to guide airflow in the first flow path; and a heat exchanger disposed on the first flow path, wherein the first flow path is formed by the guide portion and the partition, and the second flow path is formed by the partition and an inner side surface of the housing.

16. The air conditioner of claim 15, further comprising:

a first fan disposed in a circumferential direction of an inner circumferential surface of the guide portion and configured to move air in the first flow path; and a second fan disposed in a lower side of the intermediate member and configured to move air in the second flow path, wherein the first fan blows air in the first flow path, from a rear side of the air conditioner to a front side of the air conditioner, and the second fan blows air in the second flow path, from a lower side of the air conditioner to an upper side of the air conditioner.

17. The air conditioner of claim 15, wherein the partition extends from the guide portion to the inner side surface of the housing, and a side end portion of the partition is in contact with the inner side surface of the housing to divide between the first flow path and the second flow path.

18. The air conditioner of claim 15, wherein the second flow path does not pass through the heat exchanger.

19. An air conditioner comprising:

a housing having a first suction port and a second suction port;

a first discharge port disposed on a front surface of the housing;

a second discharge port disposed on a side surface of the housing;

a discharge panel disposed at a front side of the first discharge port and provided with a plurality of discharge holes;

a heat exchanger;

a first fan configured to cause air to be sucked through the first suction port;

a second fan configured to cause air to be sucked through the second suction port; and an intermediate member disposed inside of the housing and including a guide portion configured to cover an outer circumferential surface of the first blowing fan, and a partition extended from an outside surface of the guide portion to a side surface of the housing, to provide a separation between the air sucked through the first suction port and the air sucked through the second suction port, the guide portion and the partition thereby being configured to guide the air sucked through the first suction port to the first blowing fan, and from the first blowing fan to the heat exchanger to be heat exchanged by the heat exchanger, and to guide the air sucked through the second suction port to the second discharge port, without passing through the heat exchanger, to thereby be discharged through the second discharge port, wherein the air heat exchanged by the heat exchanger is discharged through the plurality of discharge holes of the discharge panel.

* * * * *